US007845461B2

(12) United States Patent
Imamura et al.

(10) Patent No.: US 7,845,461 B2
(45) Date of Patent: Dec. 7, 2010

(54) ACOUSTIC DIAPHRAGM AND SPEAKER

(75) Inventors: Satoshi Imamura, Yokohama (JP); Junji Iino, Yokohama (JP); Shinji Kamimura, Yokohama (JP)

(73) Assignee: Victor Company of Japan, Limited, Yokohama-shi (JP)

( * ) Notice: Subject to any disclaimer, the term of this patent is extended or adjusted under 35 U.S.C. 154(b) by 175 days.

(21) Appl. No.: 12/222,286

(22) Filed: Aug. 6, 2008

(65) Prior Publication Data

US 2009/0038878 A1 Feb. 12, 2009

(30) Foreign Application Priority Data

Aug. 10, 2007 (JP) ..... 2007-210498
Jul. 15, 2008 (JP) ..... 2008-184232

(51) Int. Cl.
*H04R 7/10* (2006.01)
*H04R 7/26* (2006.01)
*G10K 13/00* (2006.01)
*H04R 7/06* (2006.01)

(52) U.S. Cl. ..... 181/167; 181/166; 181/170; 381/423; 381/426

(58) Field of Classification Search ..... 181/167, 181/168, 169, 170, 166, 151, 146, 157; 381/150, 381/154, 190, 396, 423, 424, 426–432
See application file for complete search history.

(56) References Cited

U.S. PATENT DOCUMENTS 1,882,974 A * 10/1932 Schlenker ..... 181/168
1,990,409 A * 2/1935 Lawrance ..... 181/164
1,994,866 A * 3/1935 Ovenhausen ..... 181/167
2,531,634 A * 11/1950 Lawrance ..... 181/164
3,464,514 A * 9/1969 Ishimura et al. ..... 381/432
4,020,299 A * 4/1977 Garner et al. ..... 381/432
4,076,098 A * 2/1978 Ward ..... 181/170
4,100,992 A * 7/1978 Rehde et al. ..... 181/166
4,135,601 A * 1/1979 Tsukagoshi et al. ..... 181/167
4,581,496 A * 4/1986 Sweany ..... 381/429
4,654,554 A * 3/1987 Kishi ..... 381/190
4,699,242 A * 10/1987 Ono ..... 181/170
4,727,584 A * 2/1988 Hall ..... 381/96
4,893,695 A * 1/1990 Tamura et al. ..... 181/151
5,256,837 A * 10/1993 Pak, II ..... 181/164
5,304,746 A * 4/1994 Purvine ..... 181/148
6,574,347 B1 * 6/2003 Linse ..... 381/431
6,839,444 B2 * 1/2005 Ellis et al. ..... 381/152
7,120,263 B2 * 10/2006 Azima et al. ..... 381/152
7,467,686 B2 * 12/2008 Imamura et al. ..... 181/167
7,483,545 B2 * 1/2009 Nagaoka ..... 381/423
7,546,897 B2 * 6/2009 Takebe et al. ..... 181/167
7,677,355 B2 * 3/2010 Imamura et al. ..... 181/167

(Continued)

FOREIGN PATENT DOCUMENTS

JP 57023393 A * 2/1982

(Continued)

*Primary Examiner*—Edgardo San Martin
(74) *Attorney, Agent, or Firm*—The Nath Law Group; Sungyeop Chung; Jerald L. Meyer

(57) ABSTRACT

An acoustic diaphragm includes a diaphragm formed of a uniform material and a first standing wave suppression member provided on a surface of the diaphragm along a first direction of passing through a center of the diaphragm.

53 Claims, 23 Drawing Sheets

U.S. PATENT DOCUMENTS

| | | | | |
|---|---|---|---|---|
| 2001/0055402 | A1* | 12/2001 | Azima | 381/152 |
| 2004/0168851 | A1* | 9/2004 | Imamura et al. | 181/169 |
| 2005/0078850 | A1* | 4/2005 | Norton | 381/423 |
| 2006/0182307 | A1* | 8/2006 | Sakamoto | 381/423 |
| 2008/0006475 | A1* | 1/2008 | Imanishi et al. | 181/167 |
| 2008/0053745 | A1* | 3/2008 | Tada et al. | 181/165 |
| 2009/0028376 | A1* | 1/2009 | Saito et al. | 381/423 |

FOREIGN PATENT DOCUMENTS

| | | | | |
|---|---|---|---|---|
| JP | 62107599 | A | * | 5/1987 |
| JP | 63190498 | A | * | 8/1988 |
| JP | 01288100 | A | * | 11/1989 |
| JP | 03201795 | A | * | 9/1991 |
| JP | 10304492 | A | * | 11/1998 |
| JP | 2004254013 | A | * | 9/2004 |
| JP | 2009065647 | A | * | 3/2009 |

* cited by examiner

NO FRONT-SURFACE AND BACK-SURFACE STANDING WAVE SUPPRESSION MEMBERS ARE FORMED

FRONT-SURFACE AND BACK-SURFACE STANDING WAVE SUPPRESSION MEMBERS ARE FORMED

ACOUSTIC DIAPHRAGM AND SPEAKER

CROSS REFERENCE TO RELATED APPLICATIONS

This application is based upon and claims the benefit of priority from the prior Japanese Patent Applications No. P2007-210498 filed on Aug. 10, 2007, and No. P2008-184232 filed on Jul. 15, 2008; the entire contents of which are incorporated herein by reference.

BACKGROUND OF THE INVENTION

1. Field of the Invention

The present invention relates to an acoustic diaphragm and a speaker using the acoustic diaphragm.

2. Description of the Related Art

Digital audio contents with high sound quality, such as those in an audio DVD, a super audio CD (SACD) and the like, have emerged, whereby a speaker system capable of thoroughly reproducing the quality intrinsic to the contents is desired to be developed.

As a material of a diaphragm mounted on such a speaker system, a uniform material such as uniform paper, plastics, metal is widely used.

However, in a case of using the uniform material as the material of the diaphragm, a sound propagation speed is equalized in every direction, and accordingly, in some case, a standing wave is prone to occur, and sound field expression becomes poor.

As a diaphragm that enriches the sound field expression, for example, a diaphragm of the oblique cone type is known. The diaphragm of the oblique cone type is a diaphragm in which a cross-sectional shape is, made asymmetric by shifting a position of a voice coil from a center of the diaphragm. By making the cross-sectional shape asymmetric, resonance is dispersed, thus making it possible to reduce a peak that appears in treble characteristics. Accordingly, a more natural reproduced sound can be obtained.

However, since the diaphragm of the oblique cone type has a more complicated shape than a general diaphragm, it is difficult to manufacture the diaphragm of the oblique cone type. Moreover, since the diaphragm of the oblique cone type has a bias in directivity, there is also one that is rather less likely to emit a sound forward. Furthermore, in the case of using the diaphragm of the oblique cone type, there is a case where improvement of characteristics of a bass sound is not sufficient though characteristics of middle and treble sounds are improved.

Meanwhile, as another diaphragm that enriches the sound field expression, a diaphragm of the wood cone type, which uses natural wood, is also known. In the diaphragm of the wood cone type, the sound propagation speed differs between a fiber direction and directions other than the fiber direction, and accordingly, the standing wave does not occur, and good sound field expression and bass energy are also brought. The diaphragm of the wood cone type is described, for example, in Japanese Unexamined Patent Application Laid-Open (Koukai) No. 2004-254013.

An acoustic diaphragm and a speaker are desired to emerge, which can enrich the sound field expression and have excellent reproduction characteristics of the bass sound in both the case of using the uniform material as the diaphragm and the case of using the natural wood (wood sheet) as the diaphragm.

SUMMARY OF THE INVENTION

It is an object of the present invention to provide the acoustic diaphragm and the speaker, which can enrich the sound field expression and have the excellent reproduction characteristics of the bass sound.

An aspect of the present invention inheres in an acoustic diaphragm encompassing a diaphragm formed of a uniform material; and a first standing wave suppression member provided on a surface of the diaphragm along a first direction of passing through a center of the diaphragm.

Another aspect of the present invention inheres in an acoustic diaphragm encompassing a wooden diaphragm; and a first propagation speed adjustment member provided on a surface of the wooden diaphragm along a first direction of passing through a center of the wooden diaphragm, and adjusts a propagation speed at which the wooden diaphragm propagates a sound in the surface of the wooden diaphragm.

Still another aspect of the present invention inheres in a speaker encompassing an acoustic diaphragm including: a diaphragm formed of a uniform material; and a first standing wave suppression member provided on a surface of the diaphragm along a first direction of passing through a center of the diaphragm; and a cabinet which houses the acoustic diaphragm.

Still another aspect of the present invention inheres in a speaker encompassing an acoustic diaphragm including: a wooden diaphragm; and a first propagation speed adjustment member provided on a surface of the wooden diaphragm along a first direction of passing through a center of the wooden diaphragm, and adjusts a propagation speed at which the wooden diaphragm propagates a sound in the surface of the wooden diaphragm; and a cabinet which houses the acoustic diaphragm.

Still another aspect of the present invention inheres in a speaker encompassing a cabinet including a first opening and a second opening, which are spaced from each other; a first diaphragm mounted onto the first opening; a second diaphragm mounted onto the second opening; a first standing wave suppression member formed of a material having a faster sound propagation speed than the first diaphragm, disposed on a surface of the first diaphragm in a substantially horizontal direction with respect to a bottom surface of the cabinet; a second standing wave suppression member formed of the material having a faster sound propagation speed than the first diaphragm, disposed on the surface of the first diaphragm obliquely with respect to the horizontal direction; a third standing wave suppression member formed of a material having a faster sound speed than the second diaphragm, disposed on a surface of the second diaphragm in the substantially horizontal direction with respect to the bottom surface of the cabinet; and a fourth standing wave suppression member formed of the material having a faster sound propagation speed than the second diaphragm, disposed on the surface of the second diaphragm obliquely with respect to the horizontal direction, wherein the second standing wave suppression member and the fourth standing wave suppression member are inclined reversely to each other with respect to a center plane of the cabinet, the center plane intersecting perpendicularly to the bottom surface of the cabinet.

Still another aspect of the present invention inheres in a speaker encompassing a cabinet including a first opening and a second opening, which are spaced from each other; a first wooden diaphragm mounted onto the first opening; a second wooden diaphragm mounted onto the second opening; a first propagation speed adjustment member disposed on a surface of the first wooden diaphragm in a substantially horizontal direction with respect to a bottom surface of the cabinet, and adjusts a propagation speed at which the first wooden diaphragm propagates a sound in the surface of the first wooden diaphragm; a second propagation speed adjustment member disposed on the surface of the first wooden diaphragm obliquely with respect to the horizontal direction, and adjusts the propagation speed at which the first wooden diaphragm propagates the sound in the surface of the first wooden diaphragm; a third propagation speed adjustment member disposed on a surface of the second wooden diaphragm in the substantially horizontal direction with respect to the bottom surface of the cabinet, and adjusts a propagation speed at which the second wooden diaphragm propagates a sound in the surface of the second wooden diaphragm; and a fourth propagation speed adjustment member disposed on the surface of the second wooden diaphragm obliquely with respect to the horizontal direction, and adjusts the propagation speed at which the second wooden diaphragm propagates the sound in the surface of the second wooden diaphragm, wherein the second propagation speed adjustment member and the fourth propagation speed adjustment member are inclined reversely to each other with respect to a center plane of the cabinet, the center plane intersecting perpendicularly to the bottom surface of the cabinet.

BRIEF DESCRIPTION OF THE DRAWINGS

FIGS. 24A to 14F are plane views illustrating patterns examples of standing wave suppression members according to the seventh embodiment of the present invention.

DESCRIPTION OF THE PREFERRED EMBODIMENTS

Figure 1:
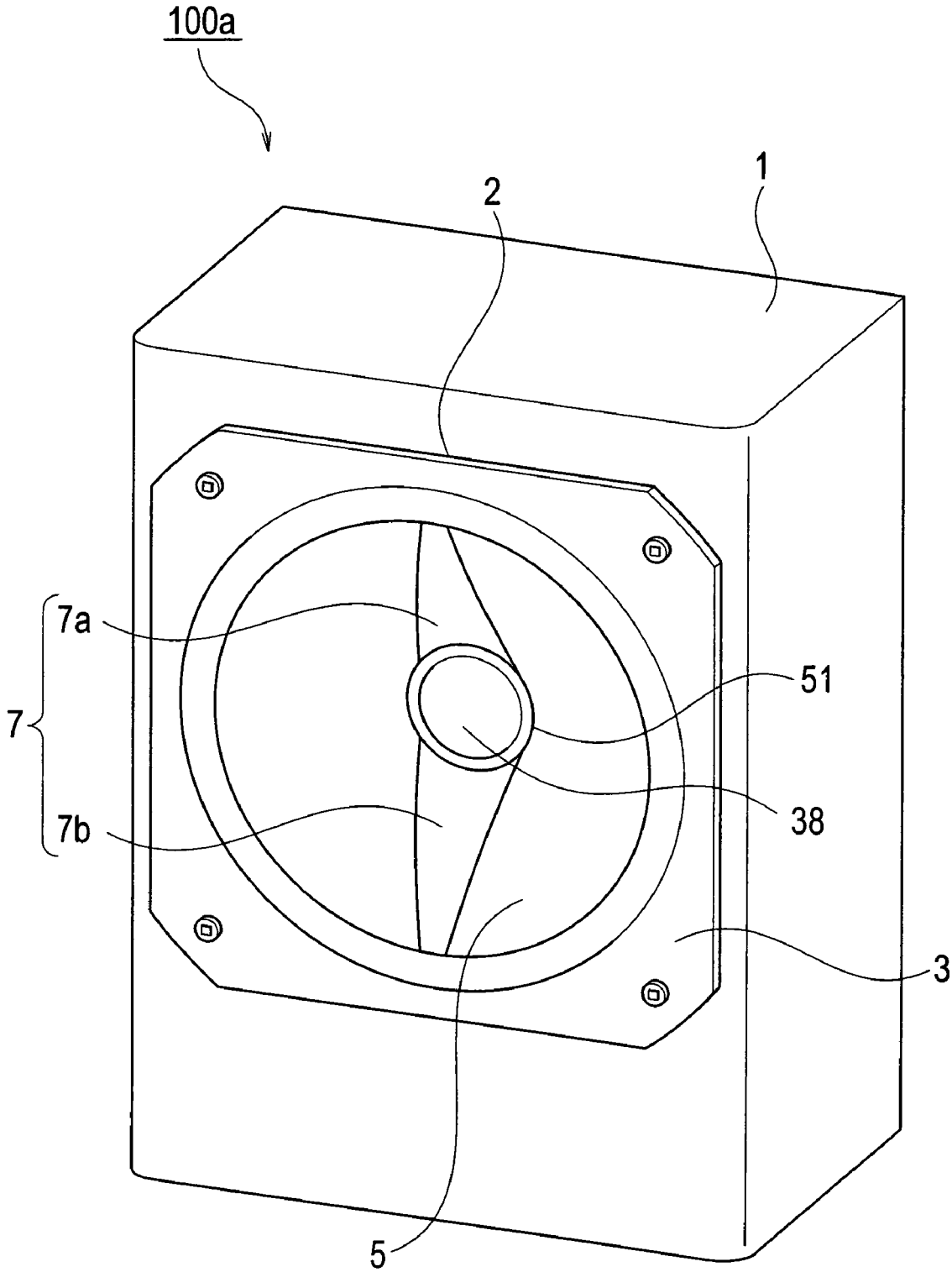
FIG. 1 is a perspective view illustrating a speaker according to a first embodiment of the present invention.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified. In the following descriptions, numerous details are set forth such as specific signal values, etc. to provide a thorough understanding of the present invention. However, it will be obvious to those skilled in the art that the present invention may be practiced without such specific details.

First Embodiment

As shown in FIG. 1, a speaker 100*a* according to a first embodiment of the present invention includes: a cabinet 1 having a unit mounting opening 2 on a front surface thereof; and a speaker unit 3 mounted on the unit mounting opening 2.

Figure 2:
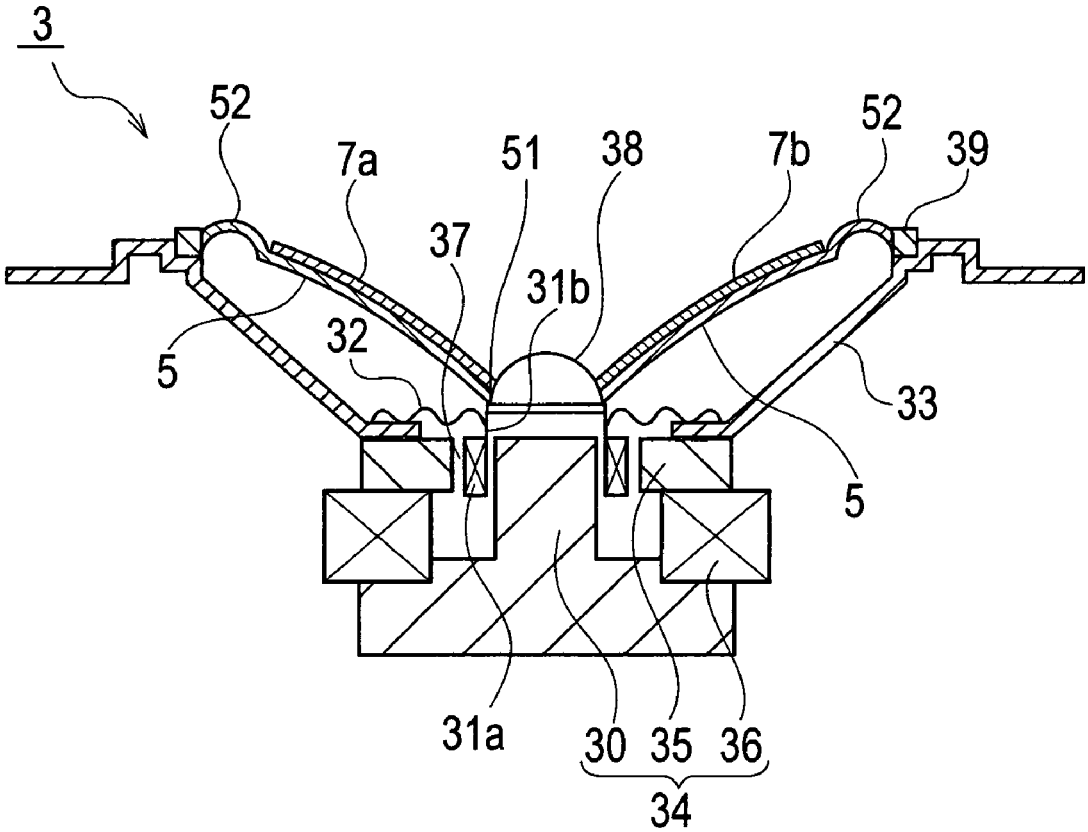
FIG. 2 is a cross-sectional view illustrating a speaker unit according to the first embodiment of the present invention.

For example, as shown in FIG. 2, the speaker unit 3 includes: a magnetic circuit 34; a frame 33 disposed on the magnetic circuit 34; and a diaphragm 5 fixed to the frame 33. The magnetic circuit 34 includes: a doughnut-like plate 35; a doughnut-like magnet 36 provided under the plate 35; and a pole piece 30. A voice coil 31*a* is movably inserted into a magnetic gap 37 between the plate 35 and the pole piece 30. A damper 32 is adhered onto a voice coil bobbin 31*b* and the frame 33.

The diaphragm 5 is formed of a uniform material (isotropic material). The "uniform material" refers to a single material in which a sound propagation speed is substantially equal in every direction in the diaphragm. As the uniform material, for example, there are mentioned paper such as pulp, plastics such as polypropylene, metal such as aluminum, and the like. A diaphragm of the wood cone type has a demerit that manufacturing cost thereof is increased since a manufacturing method thereof is complicated; however, the diaphragm 5 included therein is formed of the uniform material, and accordingly, it is easy and inexpensive to manufacture the diaphragm 5 itself.

As shown in FIG. 2, a cross section of the diaphragm 5 has a cone (conic) shape, and an opening portion 51 is provided on a center of the diaphragm 5. Onto the opening portion 51, a dust cap 38 for preventing intrusion of foreign objects into the voice coil 31*a* is attached. Onto an entire outer circumferential portion (edge) of the diaphragm 5, a rubber edge or the like is attached, and is fixed to the frame 33 while interposing a gasket 39 therebetween.

On a surface of the diaphragm 5, a pair of standing wave suppression members 7*a* and 7*b* for suppressing a standing wave generated on the diaphragm 5 are arranged. Both of the standing wave suppression members 7*a* and 7*b* are hereinafter referred to as standing wave suppression members 7. As shown in FIG. 1, the standing wave suppression members 7*a* and 7*b* are arranged opposite to each other while sandwiching the dust cap 38 therebetween so as to be substantially symmetric to each other with respect to the center of the diaphragm 5 in a direction substantially perpendicular to a bottom surface of the cabinet 1 (that is, in an up and down direction of a page space of FIG. 1). It is preferable that a thickness of the standing wave suppression members 7*a* and 7*b* be set, for example, within a range of 10 μm to 700 μm in consideration for a relationship between the thickness concerned and a gross weight of the diaphragm 5.

Figure 3A:
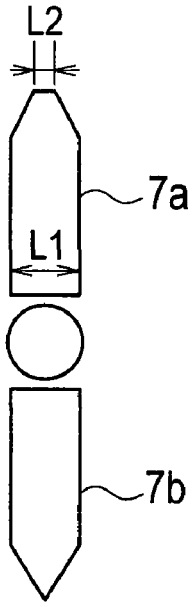
FIGS. 3A to 3F are explanatory diagrams illustrating patterns examples of standing wave suppression members according to the first embodiment of the present invention.
Figure 3B:
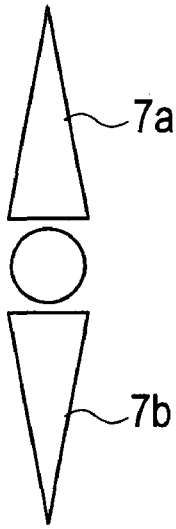
Figure 3C:
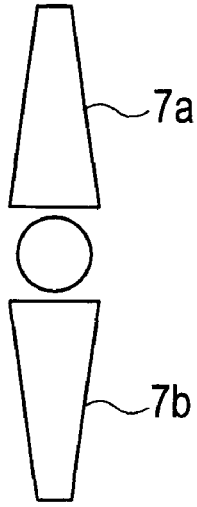
Figure 3D:
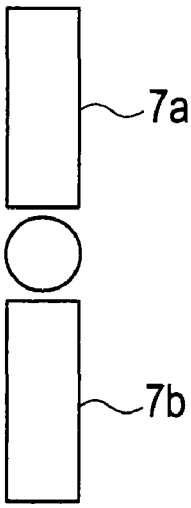
Figure 3E:
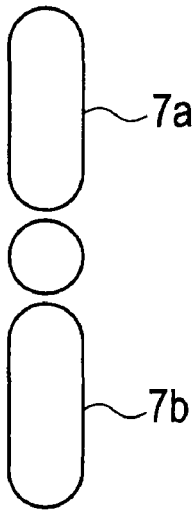
Figure 3F:
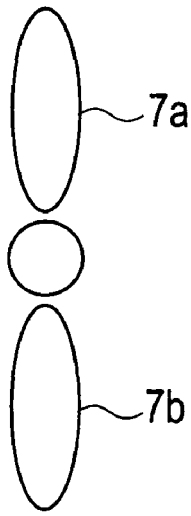

Shapes of the standing wave suppression members 7*a* and 7*b* are not particularly limited. However, for example, plates or thin films with such shapes as shown in FIGS. 3A to 3F are usable. For example, as shown in FIG. 3A, the standing wave suppression members 7*a* and 7*b*, in which widths L1 and L2 of both ends of each are differentiated from each other, are pasted on the diaphragm 5. In such a way, a change of the sound propagation speed in the case of using the diaphragm 5 as an acoustic diaphragm is increased more, and accordingly, this is preferable. Note that a relationship between the widths L1 and L2 is represented as: $0 \leqq L2 < L1$. In particular, it is preferable to adopt shapes (for example, the shapes shown in FIGS. 3A, 3B and 3C) in each of which the width of the end portion of each member on the opening portion 51 side is made wider than the width of the end portion thereof on the outer circumferential portion side.

Figure 4A:
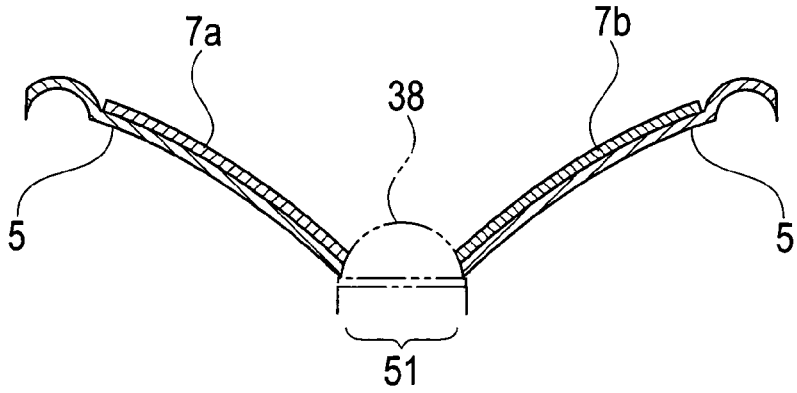
FIGS. 4A to 4C show examples of the standing wave suppression members fixed on a diaphragm according to the first embodiment of the present invention.

With regard to a fixing method of the standing wave suppression members 7*a* and 7*b*, for example, as shown in a cross-sectional view of FIG. 4A, it is preferable to paste the standing wave suppression members 7*a* and 7*b* on the entire surface of the diaphragm 5 in an intimate contact manner. As adhering means for this, for example, a double-sided adhesive tape, a commercially available adhesive, a thermosetting adhesive, heat press, and the like can be used.

Figure 4B:
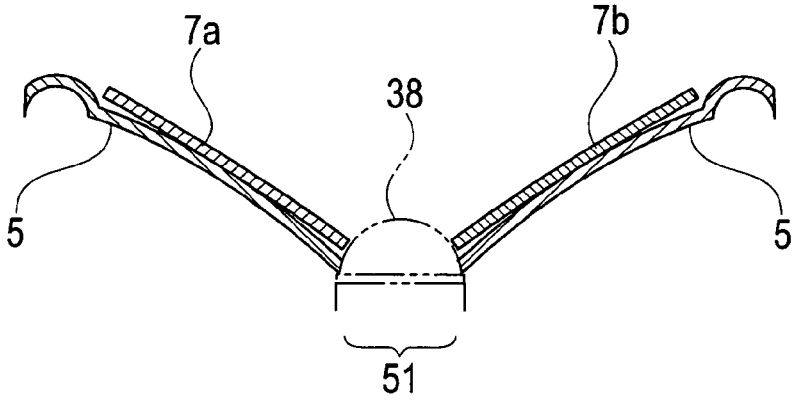
Figure 4C:
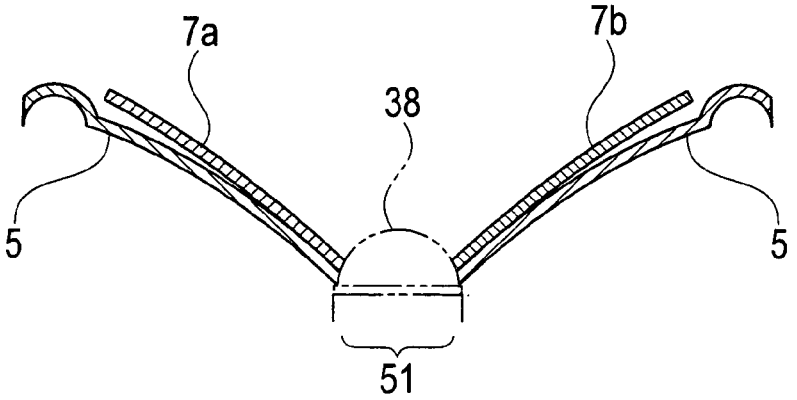

However, as shown in FIG. 4B, both ends of each of the standing wave suppression members 7*a* and 7*b* are peeled off from the surface of the diaphragm 5 in some case depending on adhesion strength of the adhering means and the material of the diaphragm 5. A sufficient effect is obtained even in the example of FIG. 4B; however, from a viewpoint of increasing the effect, it is desirable to fix at least the opening portion 51-side end portions of the standing wave suppression members 7*a* and 7*b* onto the diaphragm 5 by using the adhering means and the like so that the end portions concerned can be brought into intimate contact with the surface of the diaphragm 5. In such a way, vibrations transmitted from the voice coil 31*a* can be facilitated to be transmitted to the standing wave suppression members 7*a* and 7*b*. Therefore, a sound expansion feeling in terms of the auditory sense is obtained in the direction where the standing wave suppression members 7*a* and 7*b* are extended.

As a material of the standing wave suppression members 7*a* and 7*b*, it is preferable to use a material having a faster sound propagation speed than the material composing the diaphragm 5. For example, in the case of using the paper or the polypropylene as the material of the diaphragm 5, for example, carbon, aluminum, titanium, copper, alloys of these or the like can be used as the material of the standing wave suppression members 7*a* and 7*b*. In the case of using the metal such as the aluminum as the material of the diaphragm 5, for example, titanium, beryllium, magnesium, alloys of these or the like can be used as the material of the standing wave suppression members 7*a* and 7*b*.

In accordance with the acoustic diaphragm according to the first embodiment, as shown in FIG. 1, the standing wave suppression members 7*a* and 7*b* formed of the material having the faster sound propagation speed than the uniform material composing the diaphragm 5 are arranged in a direction of passing through the center of the diaphragm 5, that is, in the direction (the up and down direction of the page space) substantially perpendicular to the bottom surface of the cabinet 1. In such a way, a sound speed in the perpendicular direction becomes faster than those in the other directions. Accordingly, such generation of the standing wave can be suppressed even in the case of using, as the diaphragm 5, the uniform material such as the paper. In addition, sound expansion in terms of the auditory sense is generated in the direction substantially perpendicular to the bottom surface of the cabinet 1, and a sound field feeling can be further enhanced.

Moreover, in accordance with the acoustic diaphragm according to the first embodiment, the opening portion 51 is not shifted from the center of the diaphragm 5 unlike a diaphragm of the oblique cone type. Accordingly, a bass sound is not reduced. Furthermore, the acoustic diaphragm shown in FIG. 1 can be fabricated only in such a manner that the standing wave suppression members 7*a* and 7*b* with the shape shown in any of FIG. 3A to FIG. 3F are cut out from the plate-like or film-like material, and are pasted onto the surface of the diaphragm 5 by the adhesive and the like. Accordingly, the acoustic diaphragm is easy to process, and can be manufactured inexpensively.

Figure 5:
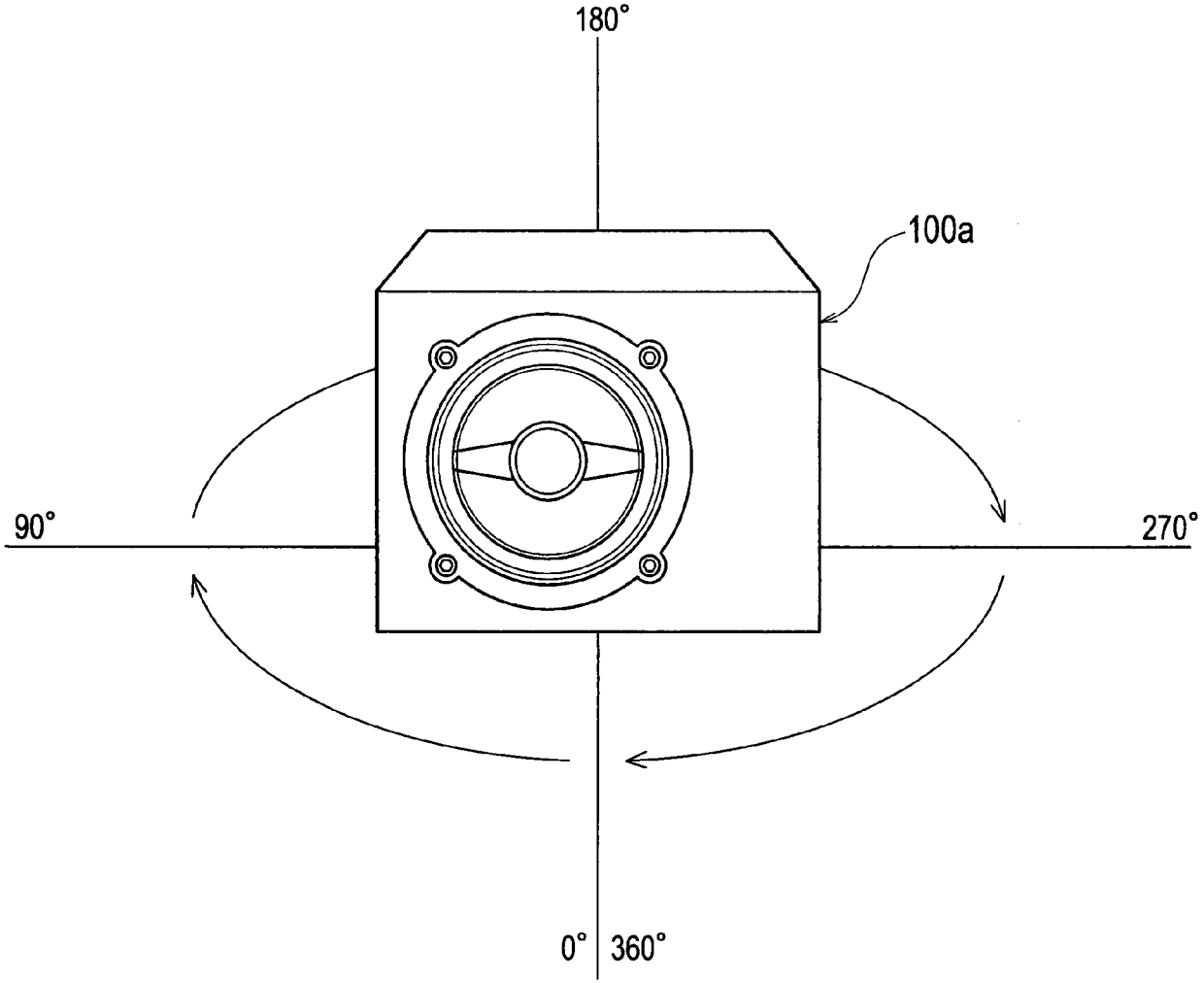
FIG. 5 is an explanatory diagram illustrating a method of measuring directional sensitivity characteristics of the speaker according to the first embodiment of the present invention.
Figure 6:
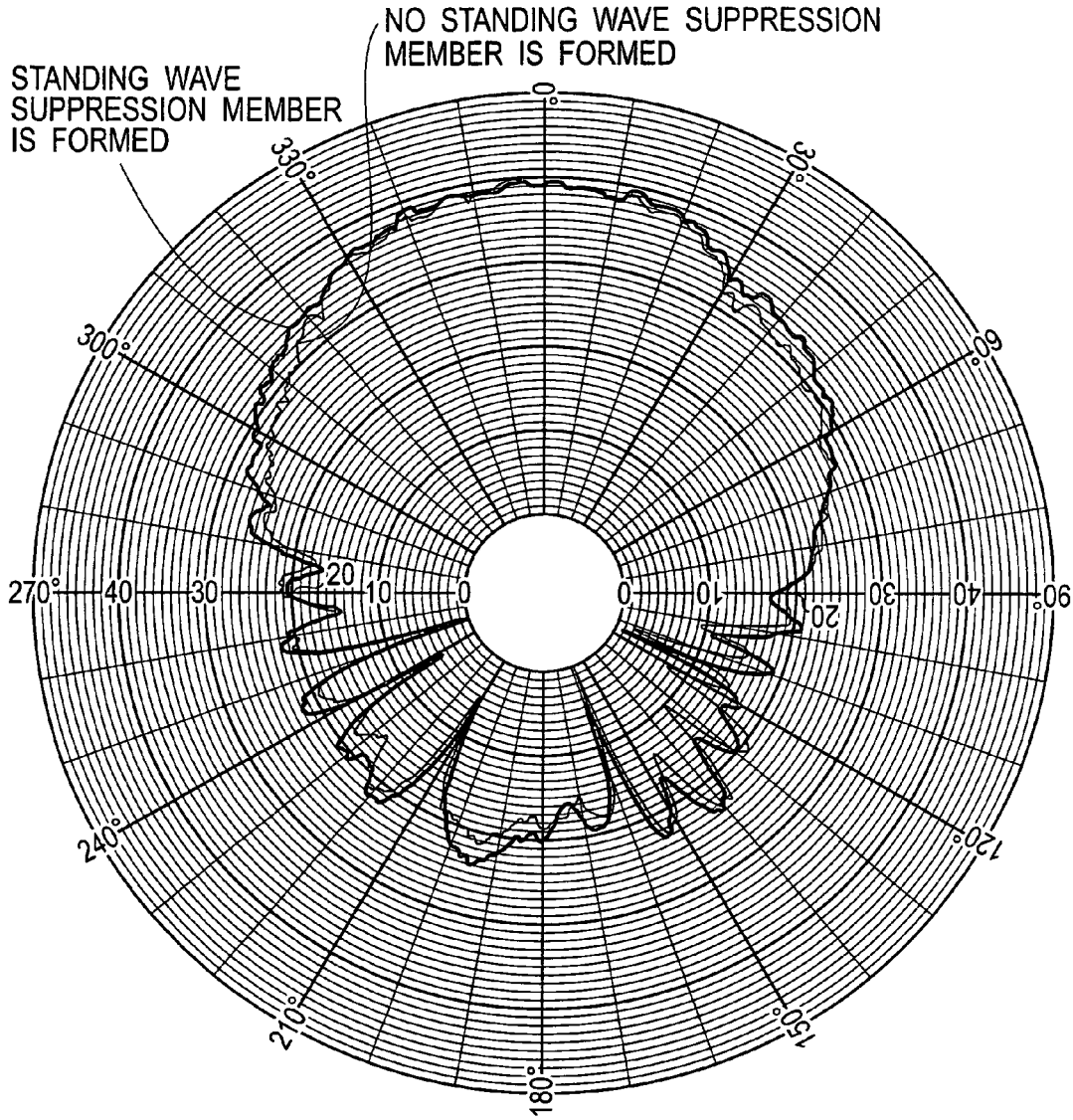
FIG. 6 is an explanatory diagram illustrating a measurement result of a directivity pattern according to the first embodiment of the present invention.

Note that, in order to investigate the characteristics of the speaker 100*a* shown in FIG. 1, directional sensitivity characteristics of the speaker 100*a* were investigated by a method as shown in FIG. 5. As shown in FIG. 5, in a test of the directional sensitivity characteristics, the speaker 100*a* shown in FIG. 1 was placed on a turn table (not shown) in a state of being laid abeam. Then, a microphone was put on a place radially apart from a center of the turn table by 1 m, and the turn table was rotated clockwise by 360 degrees while setting an initial degree of a front surface of the speaker 100*a* at 0 degree. A measurement frequency of 8 kHz was used, and a directivity pattern as shown in FIG. 6 was obtained by such a measurement for the speaker 100*a*. As a comparative example, a directivity pattern of a speaker that does not have the standing wave suppression members 7*a* and 7*b* was obtained by a measurement under a similar condition to that in the case of performing the measurement for the speaker 100*a*.

As understood from the results shown in FIG. 6, in the speaker 100*a* (bold line; standing wave suppression members are provided) in which the standing wave suppression members 7*a* and 7*b* are arranged, a level of the frequency range (8 kHz) rose by approximately 3 dB in every orientation in comparison with the speaker (thin line; no standing wave suppression members are provided) in which the standing wave suppression members 7*a* and 7*b* are not arranged. The following is understood from the above. In accordance with the acoustic diaphragm and the speaker 100*a*, which are shown in FIG. 1, even in the case of using the uniform material as the material of the diaphragm 5, the directivity characteristics are changed by arranging the standing wave suppression members 7*a* and 7*b* on the diaphragm 5, thus making it possible to impart the sound expansion to a specific direction.

Second Embodiment

Figure 7:
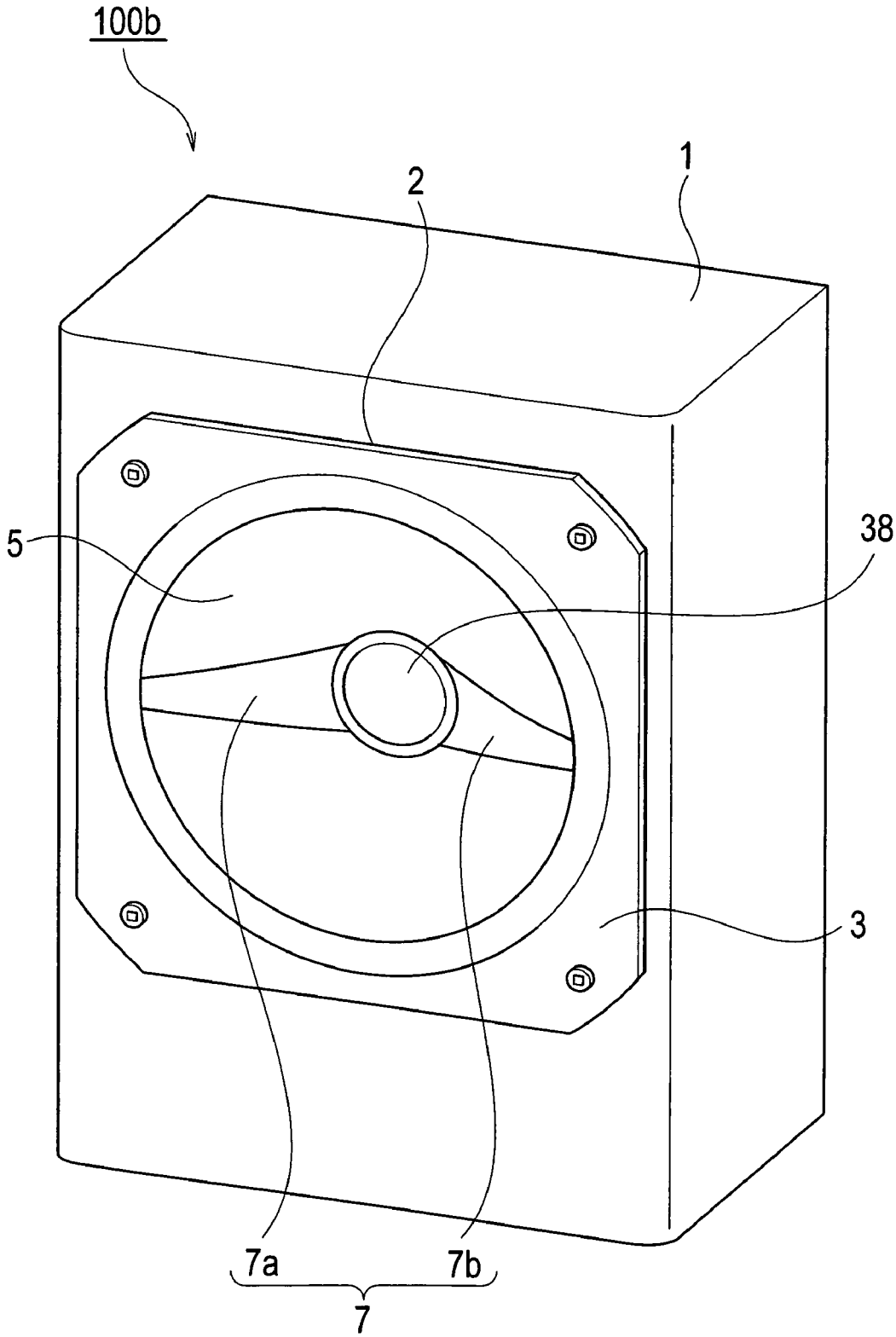
FIG. 7 is a perspective view illustrating a speaker according to a second embodiment of the present invention.

As shown in FIG. 7, a speaker 100*b* according to a second embodiment of the present invention is different from the speaker 100*a* shown in FIG. 1 in that the standing wave suppression members 7*a* and 7*b* are arranged in a substantially horizontal direction (that is, in a left and right direction of a page space of FIG. 7) with respect to the bottom surface of the cabinet 1.

The diaphragm 5 is formed of the uniform material (isotropic material). The "uniform material" in FIG. 7 refers to the single material in which the sound propagation speed is substantially equal in every direction in the diaphragm. As the uniform material, for example, the paper such as the pulp, the plastics such as the polypropylene, the metal such as the aluminum, and the like are usable.

It is preferable that a thickness of the standing wave suppression members 7*a* and 7*b* shown in FIG. 7 be set, for example, within the range of 10 μm to 700 μm in consideration for a relationship between the thickness concerned and the gross weight of the diaphragm 5.

Figure 8A:
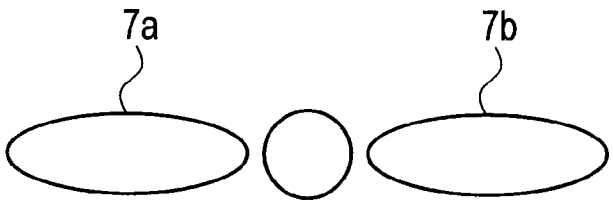
FIGS. 8A to 8F are explanatory diagrams illustrating patterns examples of standing wave suppression members according to the second embodiment of the present invention.
Figure 8B:
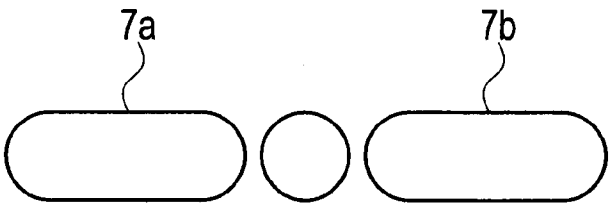
Figure 8C:
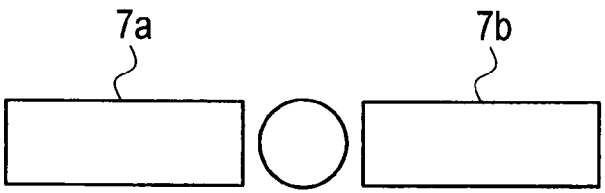
Figure 8D:
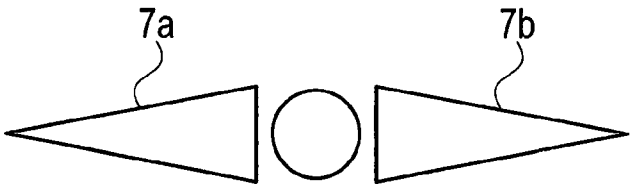
Figure 8E:
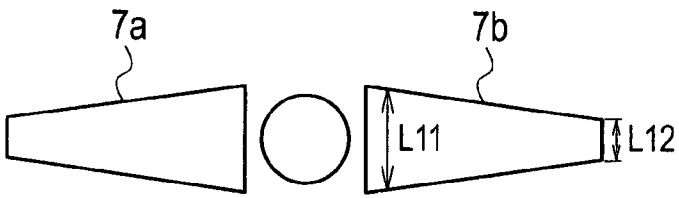
Figure 8F:
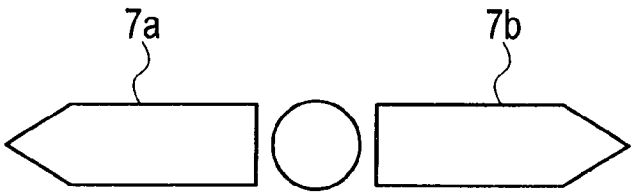

Shapes of the standing wave suppression members 7*a* and 7*b* are not particularly limited. However, for example, such slim shapes in one direction as shown in FIG. 8A to FIG. 8F are usable. For example, as shown in FIG. 8E, it is preferable to use a shape in which a width L11 of the end portion of each of the standing wave suppression members 7*a* and 7*b* on the opening portion 51 side adjacent to the voice coil 31*a* (refer to FIG. 2) is made wider than a width L12 of the end portion thereof on the outer circumference side of the diaphragm 5. In such a way, the vibrations generated in the voice coil 31*a* are facilitated to be propagated also to the standing wave suppression members 7*a* and 7*b*, and the characteristics of the propagation speed in the case of using the uniform material as the diaphragm are enhanced.

The standing wave suppression members 7*a* and 7*b* shown in FIG. 8A to FIG. 8E may be pasted onto the diaphragm 5 by using, for example, the double-sided adhesive tape, the commercially available adhesive, the thermosetting adhesive, the heat press, and the like.

As the material of the standing wave suppression members 7*a* and 7*b*, it is preferable to use a material having a sound propagation speed slower than the uniform material composing the diaphragm 5. Accordingly, for example, in the case of using the paper as the material of the diaphragm 5, for example, the plastics such as the polypropylene is used as the material of the standing wave suppression members 7*a* and 7*b*. In the case of using the metal such as the aluminum as the material of the diaphragm 5, the paper and the plastics such as the polypropylene are used as the material of the standing wave suppression members 7*a* and 7*b*.

In accordance with the acoustic diaphragm according to the second embodiment, as shown in FIG. 7, the standing wave suppression members 7*a* and 7*b* formed of the material having the sound propagation speed slower than the uniform material forming the diaphragm 5 are arranged in a direction of passing through the center of the diaphragm 3 (that is, in the substantially horizontal direction with respect to the bottom surface of the cabinet 1). In such a way, the sound speed in the substantially horizontal direction (that is, in the left and right direction of the page space) becomes slower than in the perpendicular (vertical) direction, and accordingly, the generation of the standing wave can be suppressed. Moreover, by slowing down the sound speed in the horizontal direction, the sound expansion in terms of the auditory sense in the vertical direction is obtained on the contrary. Accordingly, the acoustic diaphragm and the speaker 100*b*, in which the sound field feeling is further enhanced, are obtained.

Moreover, in accordance with the acoustic diaphragm according to the second embodiment, the opening portion 51 is not shifted from the center of the diaphragm 5 unlike the diaphragm of the oblique cone type. Accordingly, the bass sound is not reduced. Furthermore, the acoustic diaphragm shown in FIG. 7 can be fabricated only in such a manner that the standing wave suppression members 7*a* and 7*b* with the shape shown in any of FIG. 8A to FIG. 8F are cut out from the thin film-like or plate-like material, and are pasted onto the surface of the diaphragm 5 by the adhesive and the like. Accordingly, the acoustic diaphragm is easy to process, and can be manufactured inexpensively.

Third Embodiment

Figure 9:
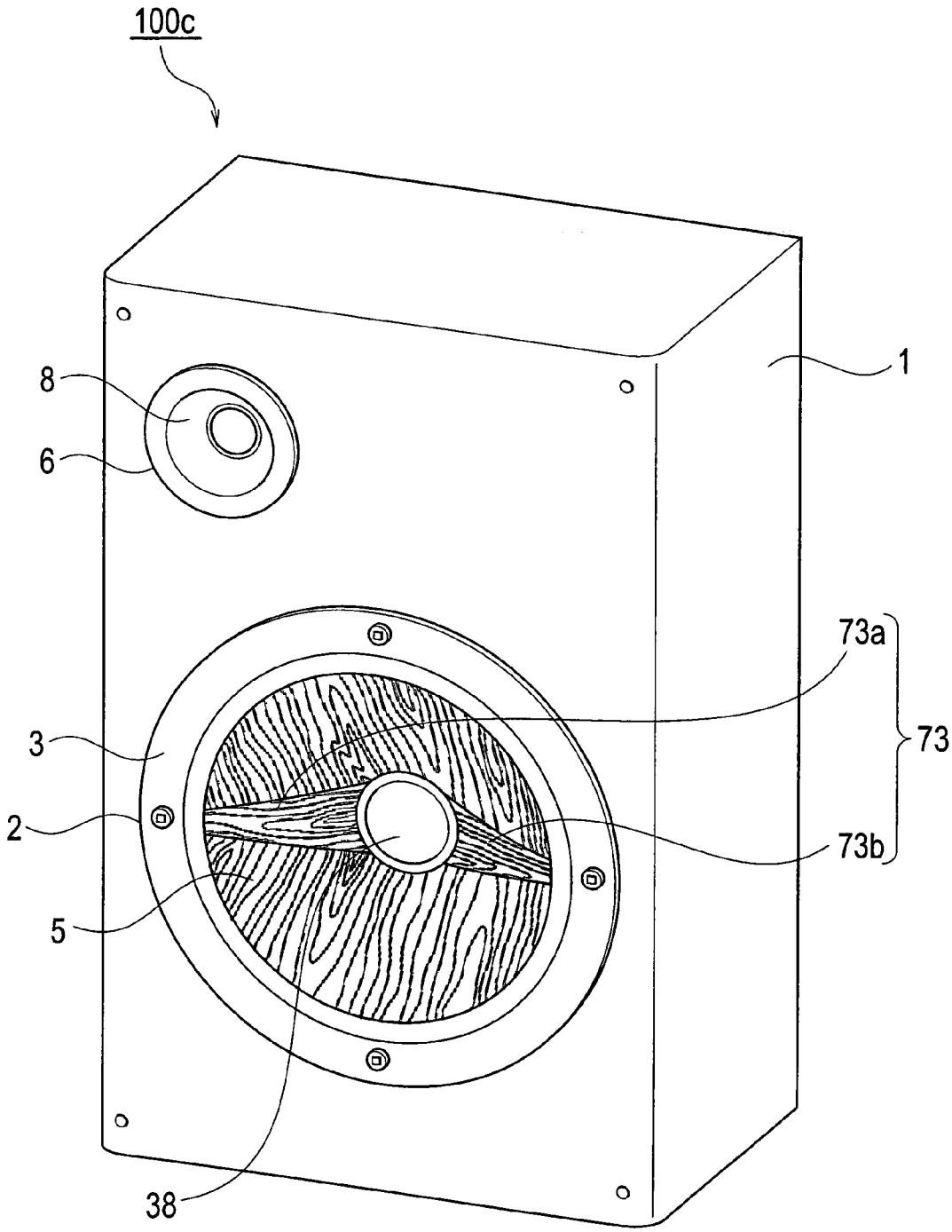
FIG. 9 is a perspective view illustrating a speaker according to a third embodiment of the present invention.

As shown in FIG. 9, a speaker 100*c* according to a third embodiment of the present invention includes: a cabinet 1 having the unit mounting opening 2 and a tweeter mounting opening 6 on a front surface thereof; the speaker unit 3 mounted on the unit mounting opening 2; and a tweeter 8 mounted on the tweeter mounting opening 6. The tweeter 8 is not essential.

A diaphragm 5 in FIG. 9 is made of wood, and is mounted on the unit mounting opening 2 so that a fiber direction thereof can go along with a direction perpendicular to the bottom surface of the cabinet 1 (that is, in an up and down direction of a page space of FIG. 9). As the wood for use in the diaphragm 5, natural wood is preferable, which satisfies the following respective conditions: for example, that it is easy to form a wooden sheet, that good acoustic characteristics are inherent, and so on in addition to that a vessel density is uniform and small, that the vessels are short, that wood fiber is long, that growth of a summerwood phase is slow, and so on. For example, birch-series materials such as monarch birch and gold birch, a magnolia bark material, maple-series materials such as painted maple and hard maple, cherry and the like can be suitably used.

On the surface of the diaphragm 5, a pair of propagation speed adjustment members 73*a* and 73*b* are arranged. The propagation speed adjustment members 73*a* and 73*b* are individually arranged in a direction of passing through a center of the diaphragm 5, that is, in a substantially horizontal direction with respect to the bottom surface of the cabinet 1 (that is, in a left and right direction of the page space) while sandwiching the dust cap 38 therebetween. Both of the propagation speed adjustment members 73*a* and 73*b* are hereinafter referred to as propagation speed adjustment members 73. In the case where the diaphragm 5 is made of the wood as described above, the standing wave is not generated on the diaphragm 5. The standing wave suppression members 7 (as shown in FIGS. 1 to 8) and the propagation speed adjustment members 73 (as shown in FIG. 9) have substantially similar shapes to each other. However, the propagation speed adjustment members 73 function as members adjusting the propagation speed at which the sound is propagated in the surface of the diaphragm 5, and accordingly, are referred to as the propagation speed adjustment members. It is preferable that a thickness of the propagation speed adjustment members 73*a* and 73*b* be set, for example, within the range of 10 μm to 700 μm in consideration for the relationship between the thickness concerned and the gross weight of the diaphragm 5.

As a material of the propagation speed adjustment members 73*a* and 73*b*, it is preferable to use a material having a faster sound propagation speed than the material of the diaphragm 5. For example, in the case of using natural tree as the propagation speed adjustment members 73*a* and 73*b*, for example, as shown in FIG. 9, wooden sheets having a fiber direction (for example, the left and right direction of the page space) different from the fiber direction of the diaphragm 5 can be pasted onto the surface of the diaphragm 5.

In general, the wooden sheets for use as the materials of the diaphragm 5 and the propagation speed adjustment members 73*a* and 73*b* have a fixed fiber direction. The propagation speed in the fiber direction of such a wooden sheet exhibits a high value; however, the propagation speed in a direction perpendicular to the fiber direction drops to a large extent. Accordingly, when a wood cone speaker with a large diameter is manufactured by using the wood cone sheet, such disadvantages can occur, that slowness of the sound propagation speed in the horizontal direction affects a reproduced sound, leading to difficulty in forward emission of the sound and lack of sound field expression.

As opposed to this, the propagation speed adjustment members 73*a* and 73*b* are arranged in the substantially horizontal direction with respect to the bottom surface of the cabinet 1 as shown in FIG. 9, whereby the sound speed in the horizontal direction can also be accelerated. Accordingly, even in the case of manufacturing the wood cone speaker with a large diameter, deterioration of the reproduced sound owing to such a delay of the propagation speed in the non-fiber direction can be suppressed. In such a way, there can be provided the acoustic diaphragm and the speaker 100*c*, in which the sound field expression is rich and directivity characteristics are good.

Note that, in the third embodiment, the uniform material such as the uniform paper and the aluminum may be substituted for the propagation speed adjustment members 73*a* and 73*b*. Moreover, besides the natural wood, other anisotropic materials having the fiber direction, for example, fiber-like materials such as fiber-like carbon and aramid may be used.

Figure 10A:
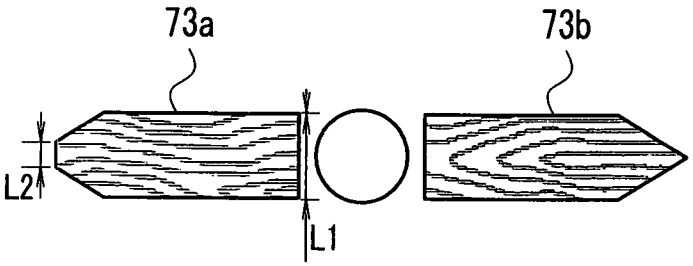
FIGS. 10A to 10F are explanatory diagrams illustrating patterns examples of propagation speed adjustment members according to the third embodiment of the present invention.
Figure 10B:
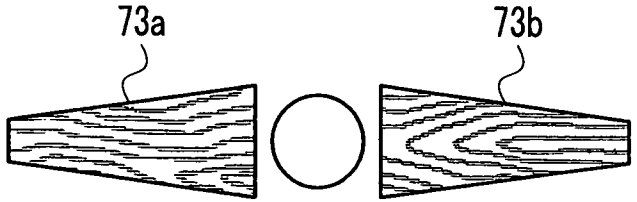
Figure 10C:
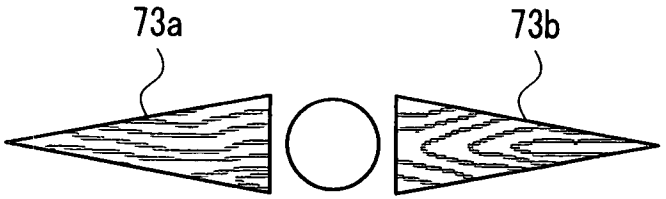
Figure 10D:
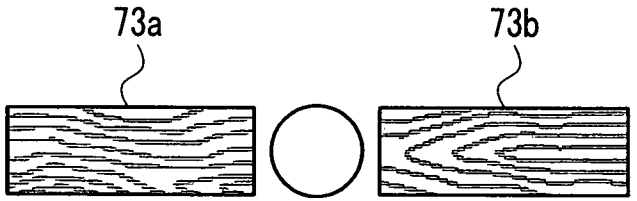
Figure 10E:
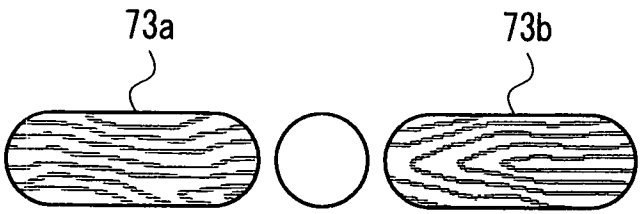
Figure 10F:
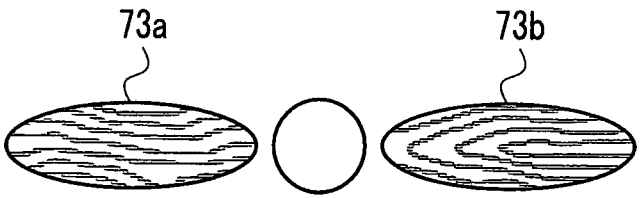

Moreover, shapes of the propagation speed adjustment members 73*a* and 73*b* are not particularly limited. However, for example, plates or thin films with such shapes as shown in FIGS. 10A to 10F are adoptable. For example, as shown in FIG. 10A, widths L1 and L2 of both ends of each of the propagation speed adjustment members 73*a* and 73*b* are differentiated from each other. Moreover, as shown in FIGS. 10B, 10C, 10E and 10F, an overall width of each of the propagation speed adjustment members 73*a* and 73*b* is changed in a longitudinal direction of each of the propagation speed adjustment members 73*a* and 73*b*. In such a way, the sound speed in the specific direction can be changed in the case of adhering the propagation speed adjustment members 73*a* and 73*b* onto the diaphragm 5. Note that a relationship between the widths L1 and L2 is represented as: $0 \leqq L2 < L1$. Furthermore, for the purpose of making it easier to transmit the vibrations generated in the voice coil 31*a*, there may be adopted such shapes as shown in FIGS. 10A, 10B and 10C, in each of which the width L1 of the end portion of each member on the opening portion 51 side adjacent to the voice coil 31*a* is made wider than the width L2 of the other end portion.

In accordance with the acoustic diaphragm according to the third embodiment, as shown in FIG. 9, the propagation speed adjustment members 73*a* and 73*b* formed of the material having the faster propagation speed than the material composing the diaphragm 5 are arranged in the substantially horizontal direction (that is, in the left and right direction of the page space) with respect to the bottom surface of the cabinet 1. In such a way, the sound speed of the diaphragm 5 in the horizontal direction is accelerated. Accordingly, even in the case of using, as the diaphragm 5, the natural wood (the wooden sheet) that is the anisotropic material, the delay of the sound speed in the horizontal direction can be relieved, and the sound field expression can be further enhanced.

Moreover, in the case of using the natural wood as the diaphragm 5, as the outer diameter of the diaphragm is increased, a malfunction such as a breakage becomes more prone to occur along the fiber direction. In accordance with the acoustic diaphragm and the speaker 100*c*, which are shown in FIG. 9, the propagation speed adjustment members 73*a* and 73*b* are formed in such a direction where mechanical strength of the diaphragm 5 is weak, and thereby play a role as reinforcement members. Accordingly, the breakage and the like of the diaphragm 5 can be suppressed. In particular, manufacturing yield in the case of manufacturing the diaphragm with a large diameter can be enhanced.

Furthermore, in accordance with the acoustic diaphragm according to the third embodiment, the opening portion 51 is not shifted from the center of the diaphragm 5 unlike the diaphragm of the oblique cone type. Accordingly, the bass sound is not reduced. Furthermore, the acoustic diaphragm shown in FIG. 9 can be fabricated only in such a manner that the propagation speed adjustment members 73*a* and 73*b* with the shape shown in any of FIG. 10A to FIG. 10F are cut out from the plate-like or thin film-like material, and are pasted onto the surface of the diaphragm 5 by the adhesive and the like. Accordingly, the acoustic diaphragm is easy to process, and can be manufactured inexpensively.

Figure 11:
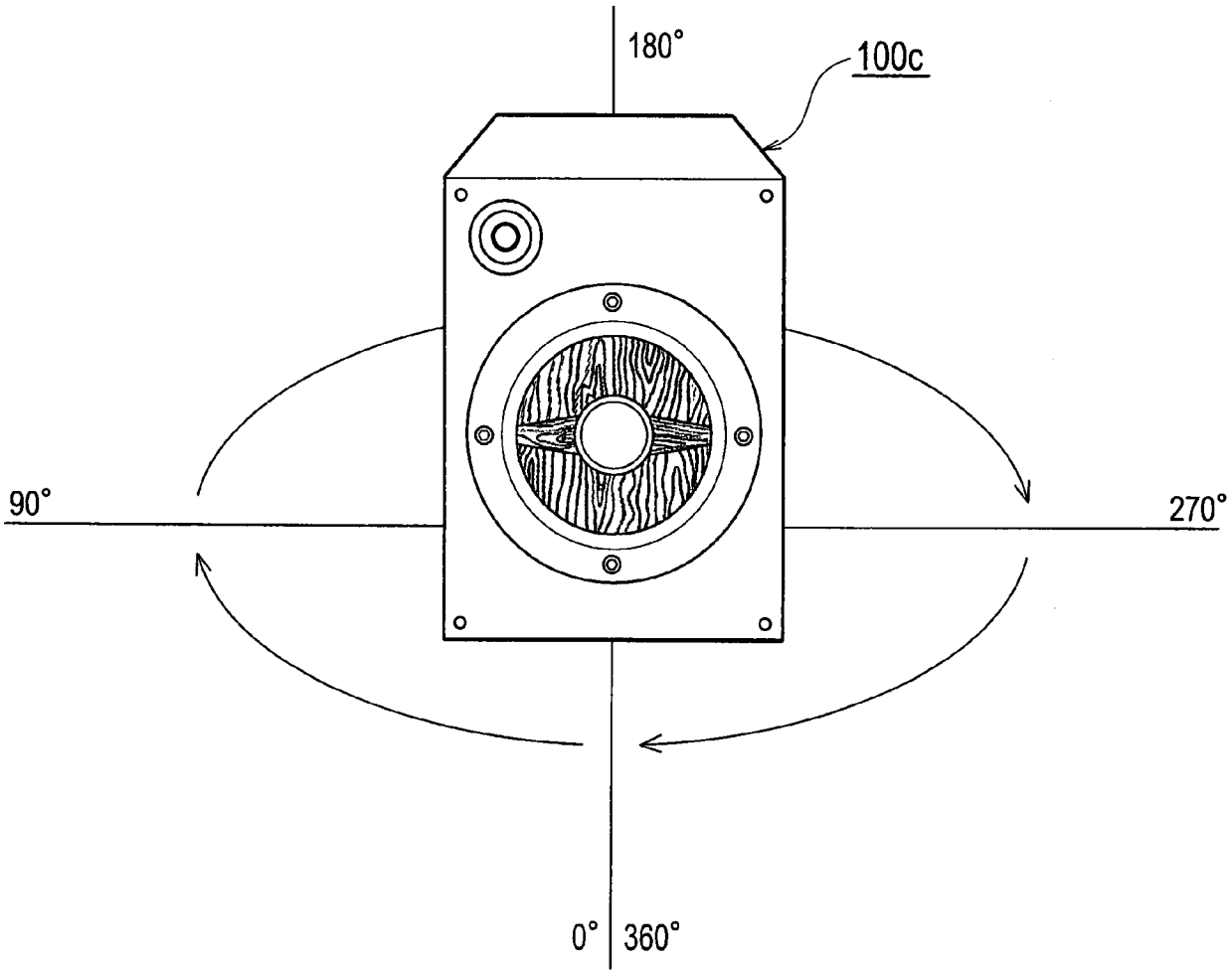
FIG. 11 is an explanatory diagram illustrating a method of measuring directional sensitivity characteristics of the speaker according to the third embodiment of the present invention.

Here, in order to investigate the characteristics of the speaker 100*c* shown in FIG. 9, directional sensitivity characteristics of the speaker 100*c* were evaluated as shown in FIG. 11. In FIG. 11, the speaker 100*c* shown in FIG. 9 was placed on the turn table (not shown) as it was, and a microphone was put on the place radially apart from the center of the turn table by 1 m. Then, the turn table was rotated clockwise by 360 degrees while setting the initial degree of a front surface of the speaker 100*c* at 0 degree. A measurement frequency of 8 kHz was used. A directivity pattern thus obtained is shown in FIG. 12.

Figure 12:
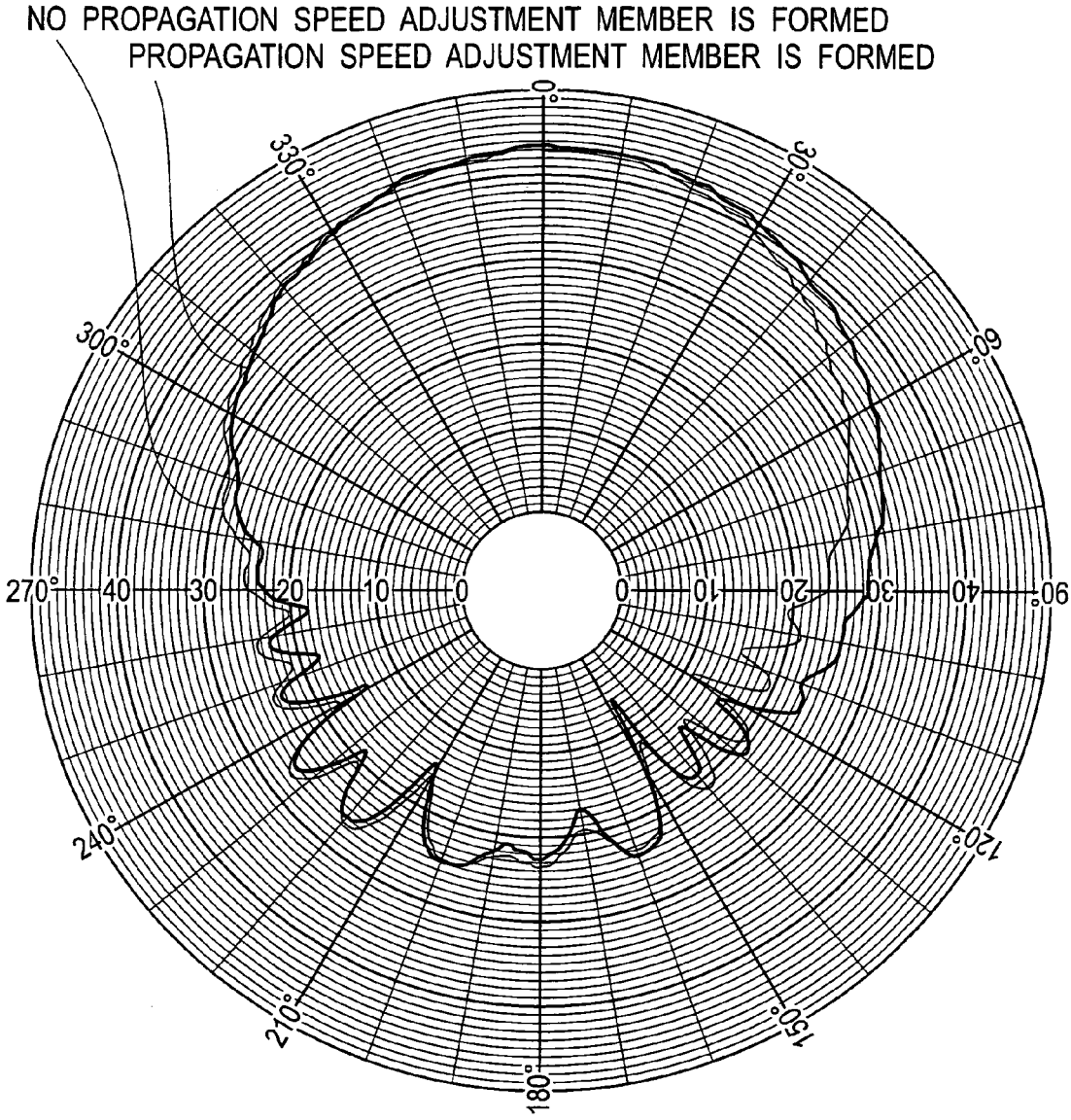
FIG. 12 is an explanatory diagram illustrating a measurement result of a directivity pattern according to the third embodiment of the present invention.

As understood from the results shown in FIG. 12, the propagation speed adjustment members 73*a* and 73*b* are arranged (bold line; propagation speed adjustment members are provided), whereby a level of the frequency range rose by approximately 5 dB within an orientation range from 30 degrees to 120 degrees in comparison with the case where the propagation speed adjustment members are not arranged (thin line; no propagation speed adjustment members are not provided). As described above, in accordance with the acoustic diaphragm and the speaker 100*c*, which are shown in FIG. 9, even in the case of using the natural wood as the material of the diaphragm 5, the sound can be emitted forward, and the sound field expression can be further enhanced.

Fourth Embodiment

Figure 13:
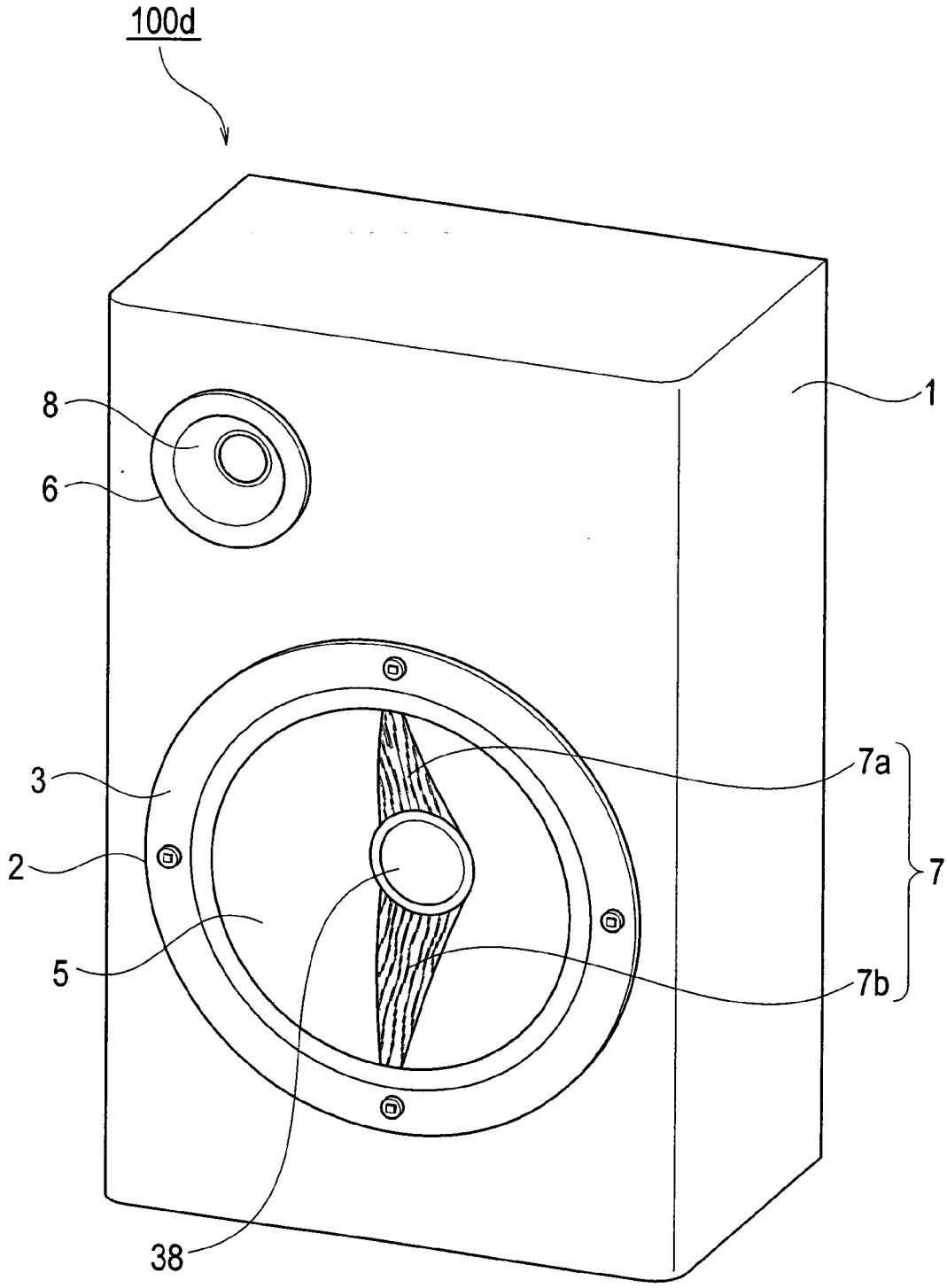
FIG. 13 is a perspective view illustrating a speaker according to a fourth embodiment of the present invention.

As shown in FIG. 13, a speaker 100*d* according to a fourth embodiment of the present invention includes: the cabinet 1 having the unit mounting opening 2 and the tweeter mounting opening 6 on the front surface thereof; the speaker unit 3 mounted on the unit mounting opening 2; and the tweeter 8 mounted on the tweeter mounting opening 6. The tweeter 8 is not essential.

The diaphragm 5 is formed of a uniform material. The "uniform material" in FIG. 13 stands for the single material in which the sound propagation speed is substantially equal in every direction in the diaphragm. As the uniform material, for example, the paper such as the pulp, the plastics such as the polypropylene, the metal such as the aluminum, and the like are used.

As the material of the standing wave suppression members 7*a* and 7*b* of FIG. 13, a material having anisotropy, in which a sound propagation speed is faster than that of the diaphragm 5, is used. For example, the standing wave suppression members 7*a* and 7*b* of FIG. 13 are wooden sheets, and are pasted on upper and lower portions of the diaphragm 5 while sandwiching the dust cap 38 therebetween so that fiber directions thereof can go along the direction substantially perpendicular to the bottom surface of the cabinet 1 (that is, in an up and down direction of a page space of FIG. 13). As the material for use in the standing wave suppression members 7*a* and 7*b*, a material is preferable, which satisfies the following respective conditions: for example, that it is easy to form wooden sheets, that good acoustic characteristics are inherent, and so on in addition to that a vessel density is uniform and small, that the vessels are short, that the wood fiber is long, that the growth of the summerwood phase is slow, and so on. For example, the birch-series materials such as the monarch birch and the gold birch, the magnolia bark material, the maple-series materials such as the painted maple and the hard maple, the cherry and the like can be suitably used. Moreover, besides the natural wood, other anisotropic materials having different propagation speeds different from each other in the horizontal direction and the vertical direction may be used as the material of the standing wave suppression members 7*a* and 7*b*.

Figure 14A:
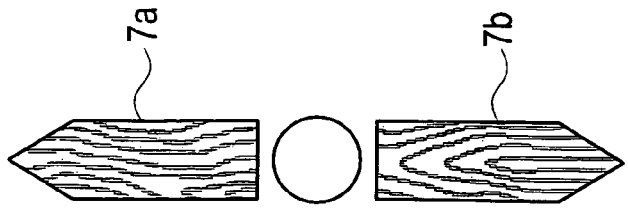
FIGS. 14A to 14F are explanatory diagrams illustrating patterns examples of standing wave suppression members according to the fourth embodiment of the present invention.
Figure 14B:
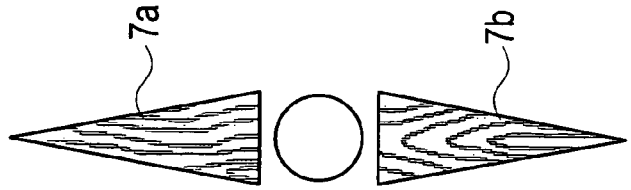
Figure 14C:
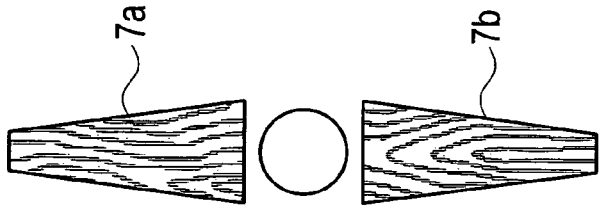
Figure 14D:
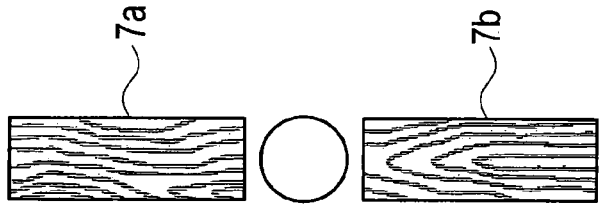
Figure 14E:
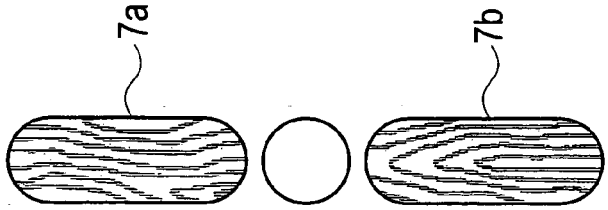
Figure 14F:
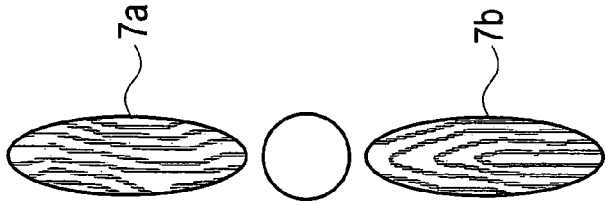

It is preferable that a thickness of the standing wave suppression members 7*a* and 7*b* be set within the range of 10 μm to 700 μm in consideration for a relationship between the thickness concerned and the gross weight of the diaphragm 5. Shapes of the standing wave suppression members 7*a* and 7*b* are not particularly limited. However, for example, plates or thin films with such shapes as shown in FIGS. 14A to 14F are usable. For example, as shown in FIGS. 14A, 14B, 14C, 14E and 14F, the standing wave suppression members 7*a* and 7*b*, in which widths of both ends of each are differentiated from each other, are pasted on the diaphragm 5. In such a way, the vibrations generated in the voice coil 31*a* are facilitated to be propagated to the standing wave suppression members 7*a* and 7*b*. In particular, for the purpose of making it easier to transmit the vibrations generated in the voice coil 31*a*, shapes as shown in FIGS. 14A, 14B and 14C are particularly preferable, in each of which the width of the end portion of each member on the opening portion 51 side adjacent to the voice coil 31*a* is made wider than the width of the other end portion.

In accordance with the acoustic diaphragm according to the fourth embodiment, as shown in FIG. 13, the standing wave suppression members 7*a* and 7*b* formed of the anisotropic material having the faster propagation speed than the material composing the diaphragm 5 are arranged in the direction substantially perpendicular to the bottom surface of the cabinet 1 (that is, in the up and down direction of the page space). In such a way, the sound speed in the horizontal direction becomes faster than in the other directions. Accordingly, the directivity characteristics in the vertical direction are expanded, and the sound expansion feeling in the vertical direction is obtained.

Moreover, in accordance with the acoustic diaphragm according to the fourth embodiment, the opening portion 51 is not shifted from the center of the diaphragm 5 unlike the diaphragm of the oblique cone type. Accordingly, the bass sound is not reduced. Furthermore, the acoustic diaphragm shown in FIG. 13 can be fabricated only in such a manner that the standing wave suppression members 7*a* and 7*b* with the shape shown in any of FIG. 14A to FIG. 14F are cut out from the plate-like or thin film-like material, and are pasted onto the surface of the diaphragm 5 by the adhesive and the like. Accordingly, the acoustic diaphragm is easy to process, and can be manufactured inexpensively.

Here, in order to investigate the characteristics of the speaker 100*d* shown in FIG. 13, directional sensitivity characteristics of the speaker 100*d* were evaluated in a similar way to the example shown in FIG. 5. As a comparative example, directional sensitivity characteristics of a speaker in which the standing wave suppression members 7*a* and 7*b* are not provided at all were evaluated.

Figure 15:
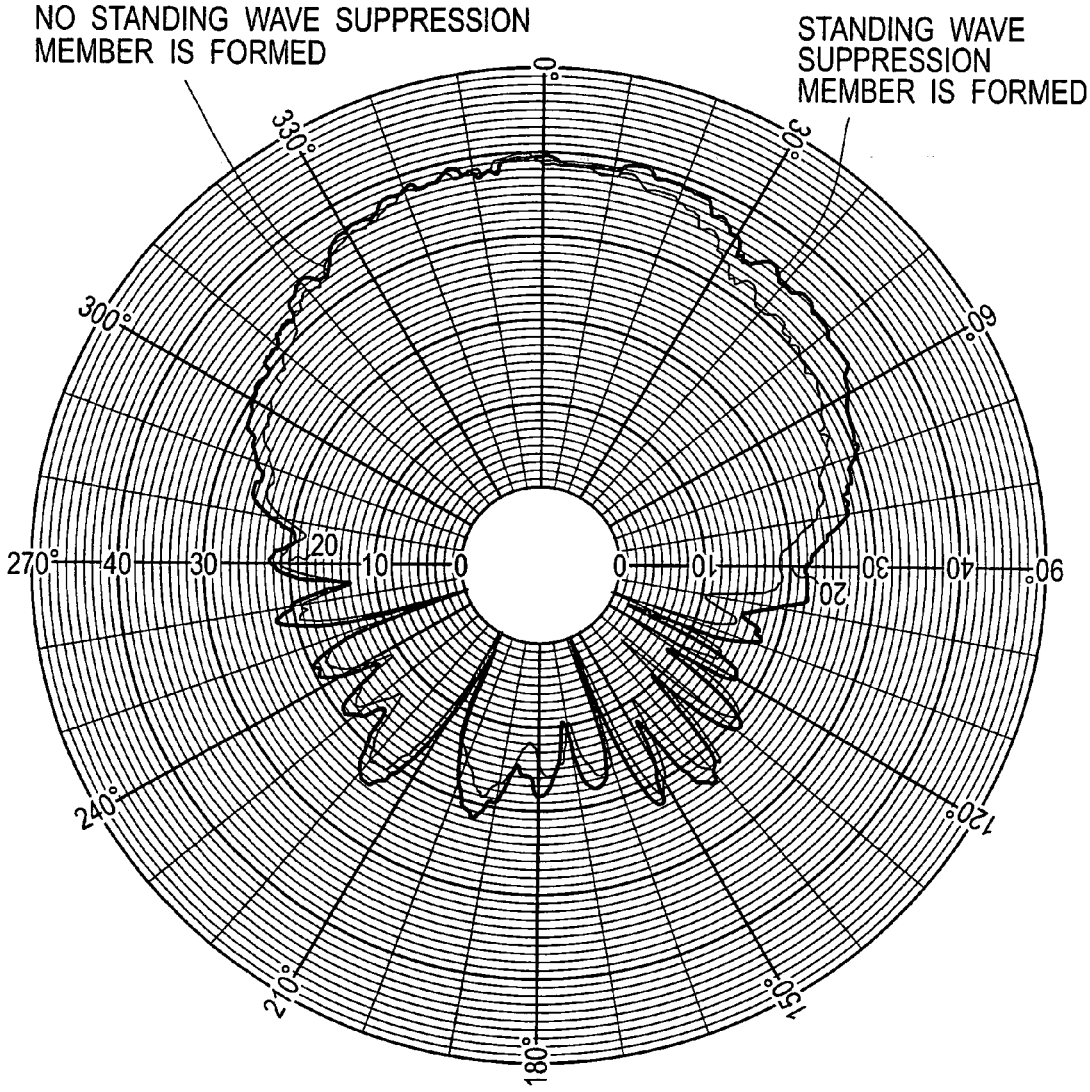
FIG. 15 is an explanatory diagram illustrating a measurement result of a directivity pattern according to the fourth embodiment of the present invention.

As understood from the results shown in FIG. 15, the standing wave suppression members 7*a* and 7*b* are arranged (bold line; standing wave suppression members are provided), whereby the level of the frequency range rose to a large extent within an orientation range from 0 degree to 120 degrees in comparison with the speaker in which the standing wave suppression members 7*a* and 7*b* are not provided at all (thin line; no standing wave suppression members are provided).

Fifth Embodiment

Figure 16:
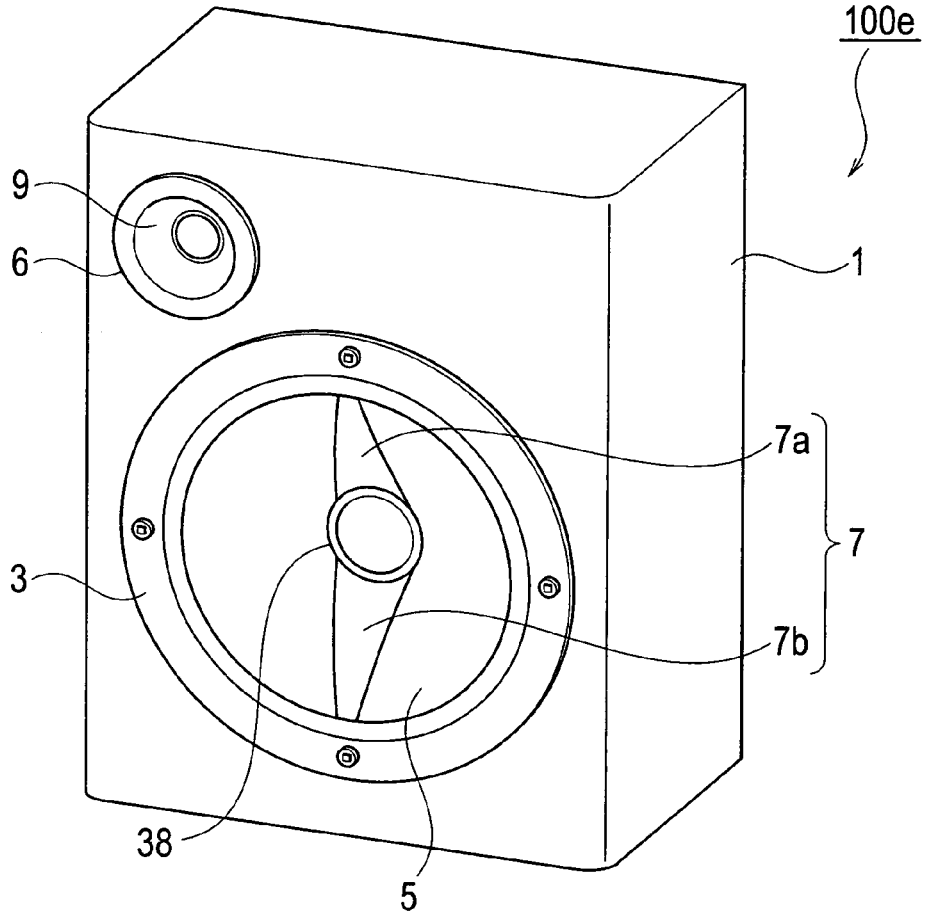
FIG. 16 is a perspective view illustrating a speaker according to a fifth embodiment of the present invention.
Figure 17:
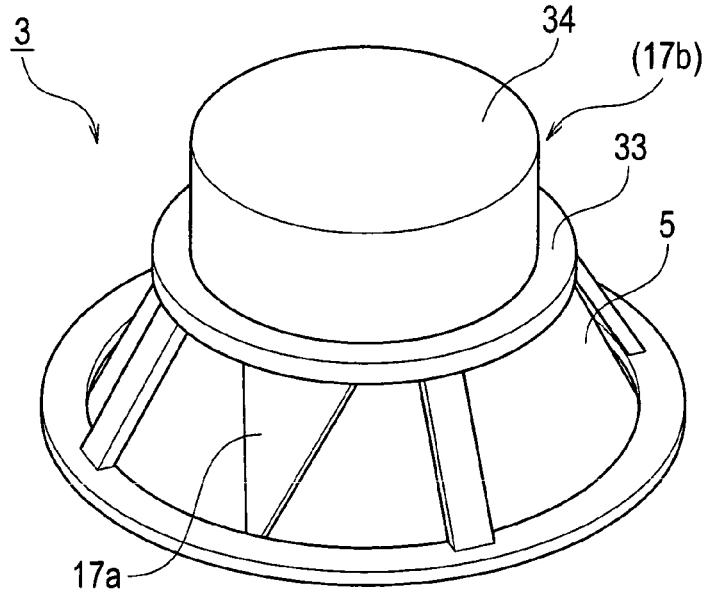
FIG. 17 is a perspective view illustrating a speaker unit according to the fifth embodiment of the present invention.

As shown in FIG. 16, a speaker 100*e* according to a fifth embodiment of the present invention includes: the cabinet 1; and the speaker unit 3 and the tweeter 8, which are mounted on the front surface of the cabinet 1. The speaker 100*e* is different from the acoustic diaphragms and the speakers 100*a* to 100*d*, which are according to the first to fourth embodiments, in further including: front-surface standing wave suppression members 7*a* and 7*b* arranged on the front surface of the diaphragm 5; and back-surface standing wave suppression members 17*a* and 17*b* arranged on a back surface of the diaphragm 5 as shown in FIG. 17. The tweeter 8 is not essential.

The back-surface standing wave suppression member 17*a* is disposed at a position opposite to the front-surface standing wave suppression member 7*a* while interposing the diaphragm 5 therebetween. The back-surface standing wave suppression member 17*b* that is not seen in FIG. 17 is disposed at a position opposite to the front-surface standing wave suppression member 7*b* while interposing the diaphragm 5 therebetween.

As a material of the front-surface standing wave suppression members 7*a* and 7*b* and the back-surface standing wave suppression members 17*a* and 17*b*, the material having the faster propagation speed than the material composing the diaphragm 5 is used. For example, in the case of using the paper or the polypropylene as the material of the diaphragm 5, the carbon, the aluminum, the titanium, the copper, the alloys of these or the like can be used as the material of the front-surface standing wave suppression members 7*a* and 7*b* and the back-surface standing wave suppression members 17*a* and 17*b*. In the case of using the metal such as the aluminum as the material of the diaphragm 5, for example, the titanium, the beryllium, the magnesium, or the alloys of these can be used as the material of the front-surface standing wave suppression members 7*a* and 7*b* and the back-surface standing wave suppression members 17*a* and 17*b*.

In the case of using the natural wood (the wooden sheet) as the material of the diaphragm 5, the front-surface standing wave suppression members 7*a* and 7*b* and the back-surface standing wave suppression members 17*a* and 17*b* become propagation speed adjustment members as described in the third embodiment. The carbon, the aluminum, the titanium, the copper or the alloys of these, or another natural wood and an anisotropic material, which have the faster propagation speed than the diaphragm 5, can be used as the propagation speed adjustment members. Others are substantially similar to those of the acoustic diaphragms and the speakers 100*a* to 100*d*, which are according to the first to fourth embodiments.

In accordance with the acoustic diaphragm and the speaker 100*e*, which are shown in FIG. 16 and FIG. 17, the front-surface standing wave suppression members 7*a* and 7*b* and the back-surface standing wave suppression members 17*a* and 17*b* are arranged on the front surface and back surface of the diaphragm 5. In such a way, the sound speed in the direction substantially perpendicular to the bottom surface of the cabinet 1 becomes faster than those in the other directions. Accordingly, even in the case of using, as the diaphragm 5, the uniform material such as the paper, the generation of the standing wave can be suppressed, and the sound also comes to be emitted further forward.

Moreover, in the case of using the natural wood as the diaphragm 5, the front-surface standing wave suppression members and the back-surface standing wave suppression members are formed thereon, whereby the acoustic diaphragm and the speaker 100*e*, in which the sound field expression is rich and the directivity characteristics are good, can be provided. Since the mechanical strength of the diaphragm 5 is increased, the manufacturing yield particularly in the case of manufacturing the diaphragm with a large diameter can also be enhanced.

Furthermore, in accordance with the acoustic diaphragm according to the fifth embodiment, the opening portion 51 is not shifted from the center of the diaphragm 5 unlike the diaphragm of the oblique cone type. Accordingly, the bass sound is not reduced. Furthermore, the acoustic diaphragm shown in FIG. 16 and FIG. 17 can be fabricated only in such a manner that the front-surface standing wave suppression members 7*a* and 7*b* and the back-surface standing wave suppression members 17*a* and 17*b*, which have a desired shape, are cut out from the plate-like or film-like raw material, and are pasted onto the front surface and back surface of the diaphragm 5 by the adhesive and the like. Accordingly, the acoustic diaphragm is easy to process, and can be manufactured inexpensively.

Here, in order to investigate the characteristics of the speaker 100*e* shown in FIG. 16, directional sensitivity characteristics of the speaker 100*e* were evaluated in a similar way to the example shown in FIG. 11. As a first comparative example, directional sensitivity characteristics of a speaker, in which the front-surface standing wave suppression members 7*a* and 7*b* and the back-surface standing wave suppression members 17*a* and 17*b* are not provided at all, were evaluated (refer to FIG. 18). As a comparative example, directional sensitivity characteristics of a speaker, in which only the front-surface standing wave suppression members 7*a* and 7*b* are provided, were also evaluated (refer to FIG. 19).

Figure 18:
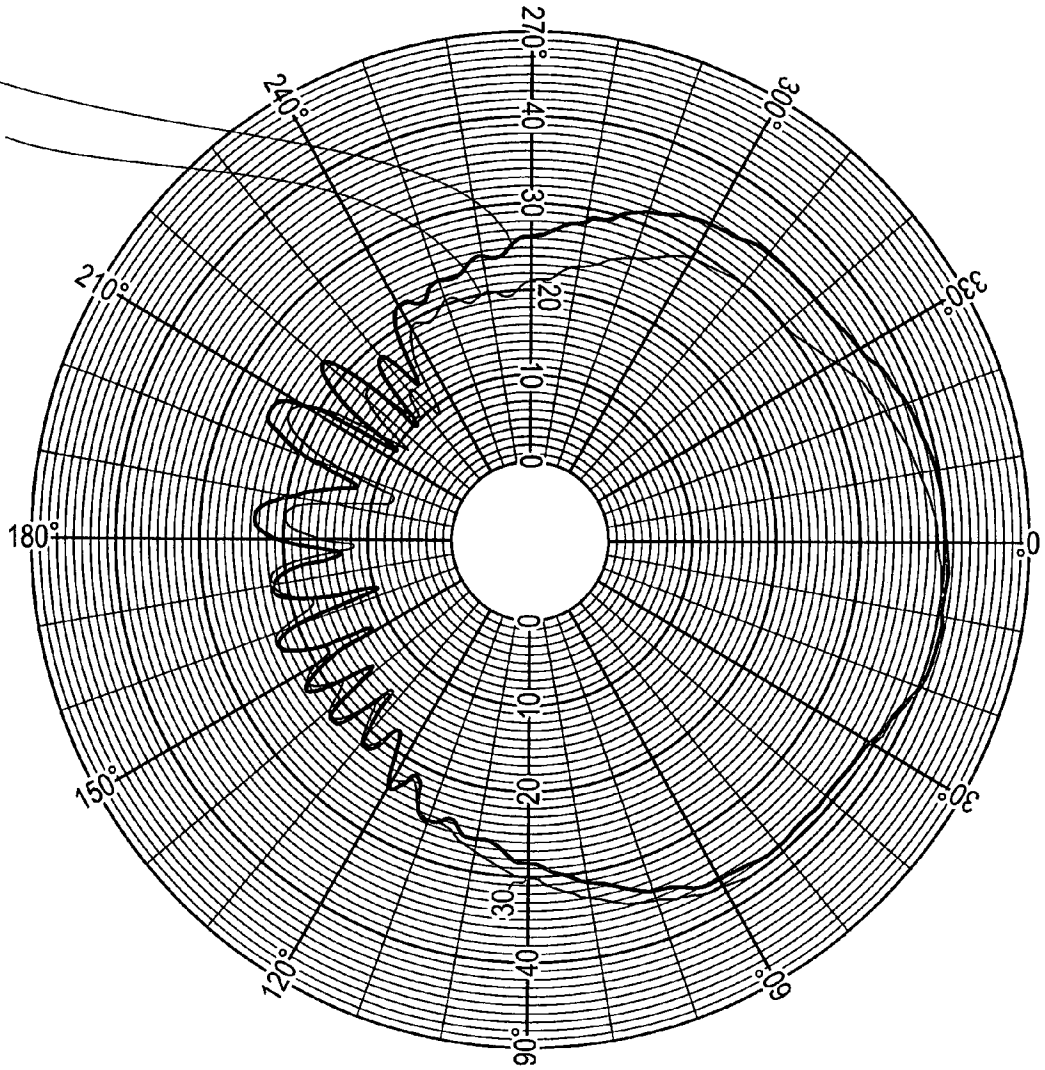
FIG. 18 is an explanatory diagram illustrating a measurement result of a directivity pattern according to the fifth embodiment of the present invention.

As understood from results shown in FIG. 18, the front-surface standing wave suppression members 7*a* and 7*b* and the back-surface standing wave suppression members 17*a* and 17*b* are arranged (bold line; standing wave suppression members are provided), whereby the level of the frequency range rose to a large extent particularly within orientation ranges from 0 degree to 120 degrees and 240 degrees to 360 degrees in comparison with the speaker in which the standing wave suppression members are not provided at all (thin line; no standing wave suppression members are provided).

Figure 19:
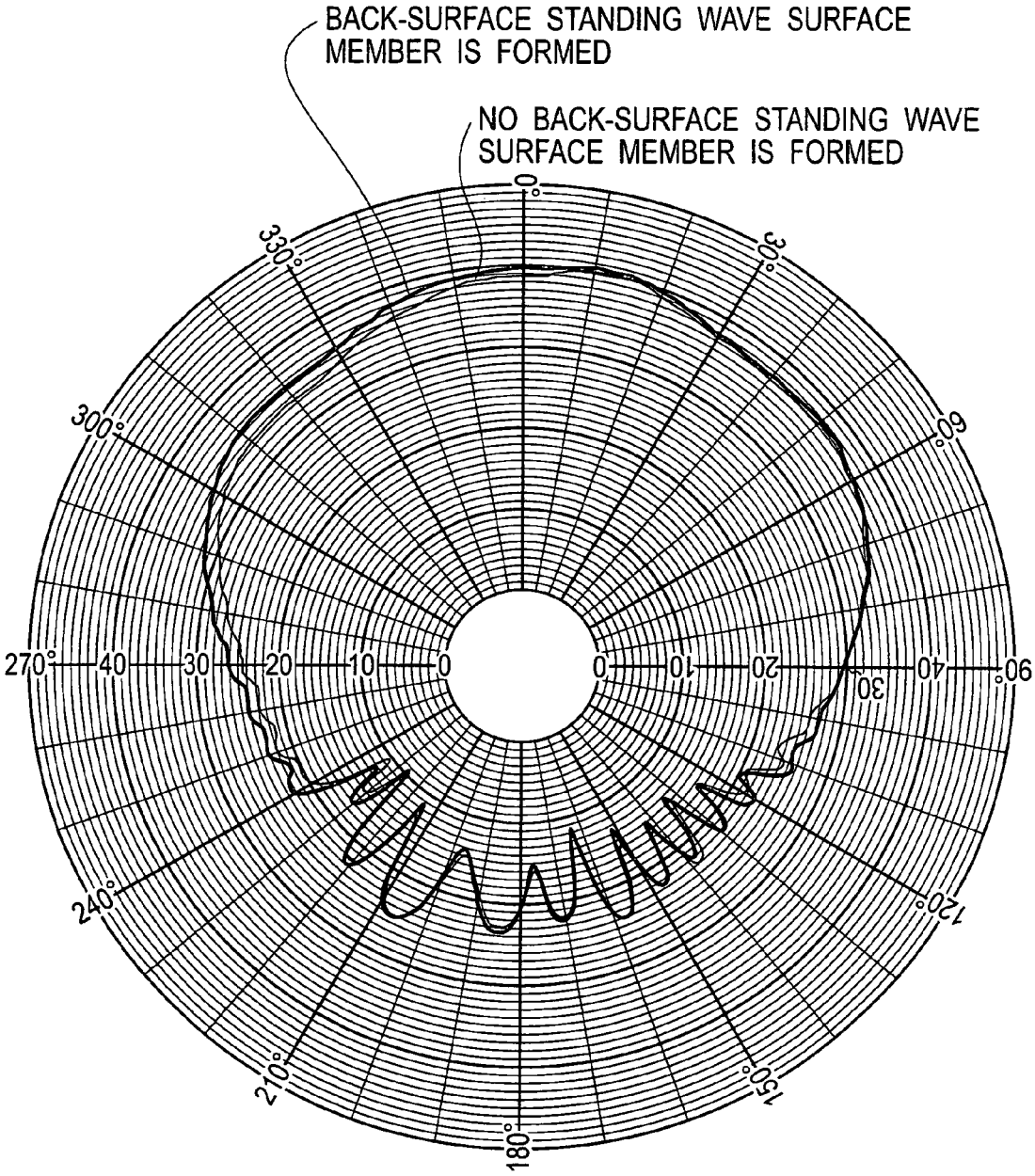
FIG. 19 is an explanatory diagram illustrating a measurement result of a directivity pattern according to the fifth embodiment of the present invention.

Moreover, as understood from results shown in FIG. 19, in the case of arranging the front-surface standing wave suppression members 7*a* and 7*b* and the back-surface standing wave suppression members 17*a* and 17*b* on both surfaces of the diaphragm 5 (bold line; back-surface standing wave suppression members are provided), the level of the frequency range was increased within orientation ranges from 90 degrees to 150 degrees and 240 degrees to 360 degrees in comparison with the case of arranging the standing wave suppression members only on the front surface (thin line; no back-surface standing wave suppression members are provided).

Sixth Embodiment

Figure 20:
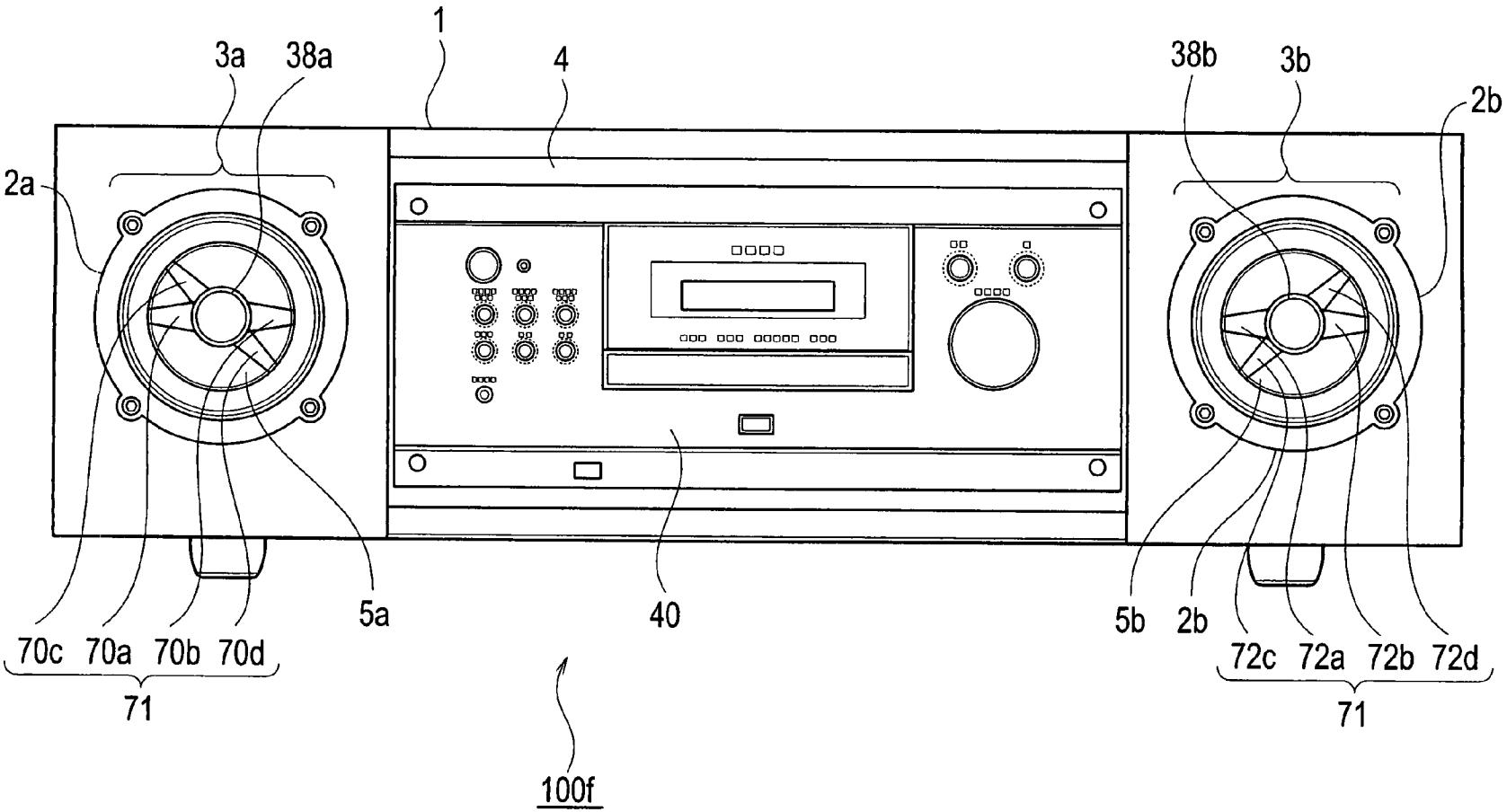
FIG. 20 is a perspective view illustrating a speaker according to a sixth embodiment of the present invention.

As shown in FIG. 20, a speaker 100*f* according to a sixth embodiment of the present invention includes: a cabinet 1 having an amplifier housing portion 4 that houses an amplifier 40 provided in a center portion of the speaker 100*f* therein and having a unit mounting openings 2*a* and 2*b* provided on the periphery of the amplifier 40; and speaker units 3*a* and 3*b* mounted onto the unit mounting portions 2*a* and 2*b*, respectively.

Figure 21:
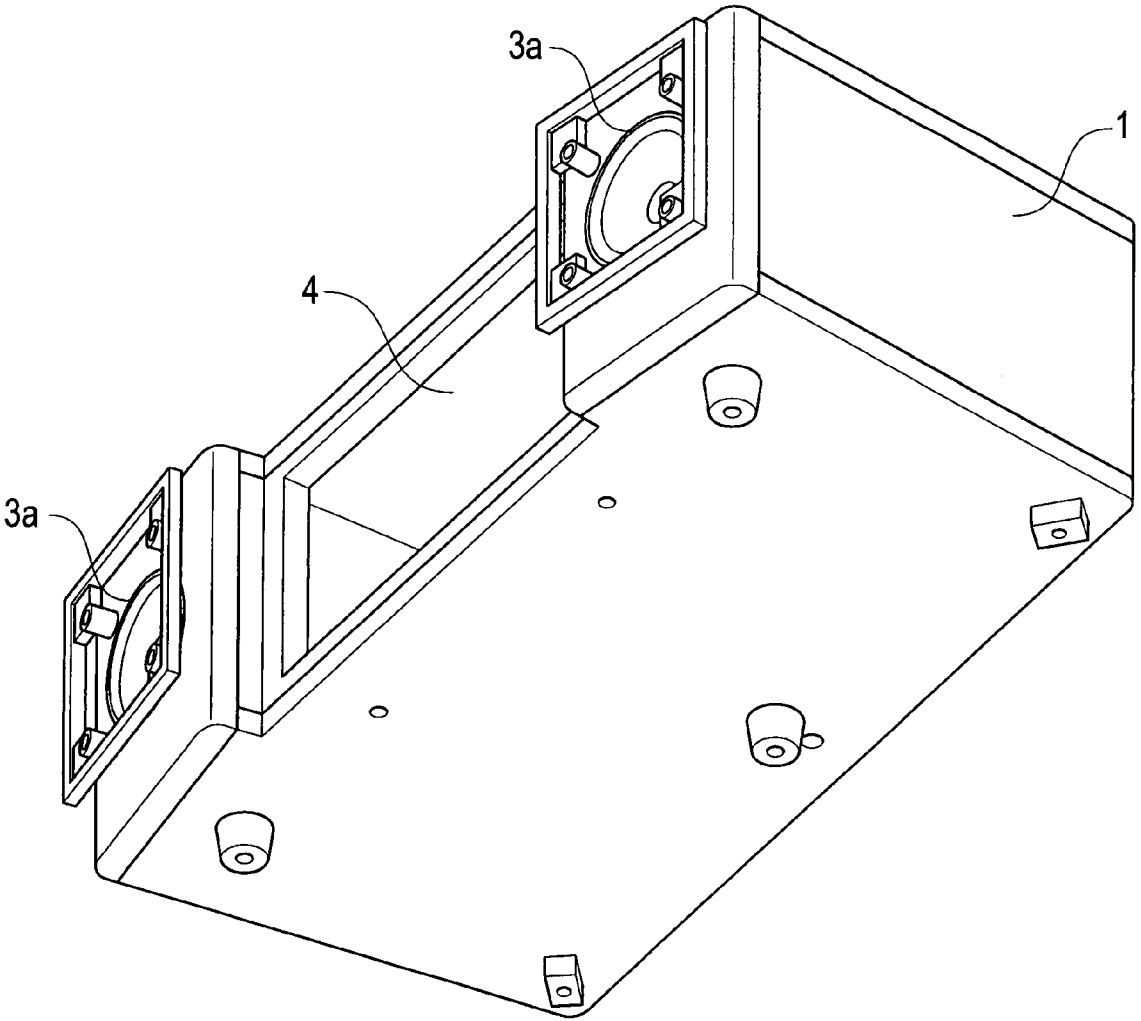
FIG. 21 is a perspective view illustrating a cabinet according to the sixth embodiment of the present invention.

The cabinet 1 is wooden cabinet, and as shown in FIG. 21, is formed as an integral type capable of simultaneously housing the speaker units 3*a* and 3*b* and the amplifier 40 therein. A distance between the speaker units 3*a* and 3*b* is, for example, in a range of 15 cm to 60 cm.

The speaker unit 3*a* includes: a diaphragm 5*a*; a pair of first standing wave suppression members 70*a* and 70*b* arranged in a substantially horizontal direction (that is, in a left and right direction of a page space of FIG. 20) with respect to a bottom surface of the cabinet 1 while sandwiching a dust cap 38*a* therebetween; and a pair of second standing wave suppression members 70*c* and 70*d* arranged in an upper left direction of the page space and a lower right direction of the page space while sandwiching the dust cap 38*a* therebetween.

The speaker unit 3*b* includes: a diaphragm 5*b*; a pair of first standing wave suppression members 72*a* and 72*b* arranged in the substantially horizontal direction (that is, in the left and right direction of the page space) with respect to the bottom surface of the cabinet 1 while sandwiching a dust cap 38*b* therebetween; and a pair of second standing wave suppression members 72*c* and 72*d* arranged in an upper right direction of the page space and a lower left direction of the page space while sandwiching the dust cap 38*b* therebetween.

Note that, in FIG. 20, the second standing wave suppression members 70*c* and 70*d* and the second standing wave suppression members 72*c* and 72*d* are positionally adjusted so as to be inclined reversely to each other in the case of taking, as a reference, a plane that passes through a center of the cabinet and is perpendicular to the bottom surface of the cabinet. In such a way, in a sound reproduced from the speaker unit 3*a* located on a left side of the page space, a sound speed thereof is accelerated in a left oblique direction. Meanwhile, in a sound reproduced from the speaker unit 3*b* located on a right side of the page space, a sound speed thereof is accelerated in a right oblique direction.

The diaphragms 5*a* and 5*b* are formed of a uniform material or natural wood, which is similar to those described in the first to fourth embodiments. In the case where the diaphragms 5*a* and 5*b* are formed of the natural wood, the standing wave suppression members 70*a*, 70*b*, 70*c*, 70*d*, 72*a*, 72*b*, 72*c* and 72*d* become the propagation speed adjustment members. A material having a faster propagation speed than the diaphragms 5*a* and 5*b* is used as a material of the standing wave suppression members 70*a*, 70*b*, 70*c*, 70*d*, 72*a*, 72*b*, 72*c* and 72*d*. For example, in the case where the paper or the polypropylene is used as the material of the diaphragms 5*a* and 5*b*, for example, the carbon, the aluminum, the titanium, the copper, the alloys of these or the like can be used as the material of the standing wave suppression members 70*a*, 70*b*, 70*c*, 70*d*, 72*a*, 72*b*, 72*c* and 72*d*. In the case where the metal such as the aluminum is used as the material of the diaphragms 5*a* and 5*b* for example, the titanium, the beryllium, the magnesium, or the alloys of these can be used as the material of the standing wave suppression members 70*a*, 70*b*, 70*c*, 70*d*, 72*a*, 72*b*, 72*c* and 72*d*. In the case where the fiber direction of the natural wood for use in the diaphragms 5*a* and 5*b* goes along an up and down direction of the page space, natural wood or an anisotropic material, which has a fiber direction in the left and right direction of the page space, can be used.

It is preferable that a thickness of the standing wave suppression members 70*a*, 70*b*, 70*c*, 70*d*, 72*a*, 72*b*, 72*c* and 72*d* be set within the range of 10 μm to 700 μm in consideration for a relationship between the thickness concerned and gross weight of the diaphragms 5*a* and 5*b*. Others are substantially similar to those of the acoustic diaphragms and the speakers 100*a* to 100*e*, which are according to the first to fifth embodiments.

In accordance with the acoustic diaphragms and the speaker 100*f*, which are according to the sixth embodiment, the standing wave suppression members 70*a*, 70*b*, 70*c*, 70*d*, 72*a*, 72*b*, 72*c* and 72*d* (or the propagation speed adjustment members) are provided, whereby the sound propagation speed is varied in each of the diaphragms 5*a* and 5*b*. In such a way, even in the case of using the uniform material such as the paper as the material of the diaphragms 5*a* and 5*b*, the generation of the standing wave can be suppressed, and the sound field expression is enhanced. In addition, the sound also comes to be emitted further forward, and it becomes possible to reproduce a sound having a three-dimensional feeling in terms of the auditory sense.

In particular, since a conventional speaker similar to the speaker 100*f* as shown in FIG. 20 has been composed as the integral type in which the distance between the speaker unit 3*a* and the speaker unit 3*b* is relatively short, a stereo feeling has not been expressed, the sound has been concentrated on a center in front of the speaker 100*f*, and a large-scale feeling and a sound field feeling have been insufficient. As opposed to this, in accordance with the speaker 100*f*, for the diaphragm 5*a* on the left side of the page space, the standing wave suppression members 70*a*, 70*b*, 70*c* and 70*d* (or the propagation speed adjustment members) are arranged so that the sound speeds in the left and right direction and the left oblique direction can be accelerated, and for the diaphragm 5*b* on the right side of the page space, the standing wave suppression members 72*a*, 72*b*, 72*c* and 72*d* (or the propagation speed adjustment members) are arranged so that the sound speeds in the left and right direction and the right oblique direction can be accelerated. In such a way, even the speaker 100*f* of the integral type, in which the distance between the speaker units 3*a* and 3*b* is short, becomes capable of reproducing a sound having a larger three-dimensional feeling than the conventional speaker.

Seventh Embodiment

Figure 22:
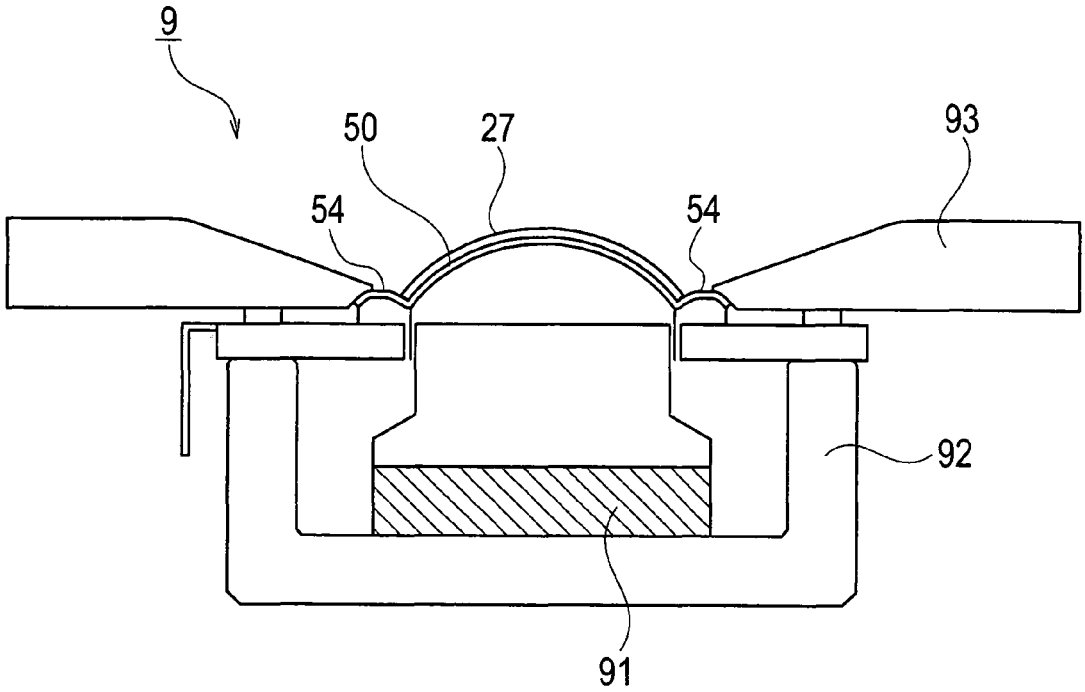
FIG. 22 is a cross-sectional view illustrating a speaker unit according to a seventh embodiment of the present invention.

As shown in FIG. 22, a speaker unit 9 according to a seventh embodiment of the present invention includes: a magnetic circuit 91; a housing portion 92 that houses the magnetic circuit 91 therein; a diaphragm 50 that has a dome shape and is disposed on the magnetic circuit 91; a belt-like standing wave suppression member 27 disposed on a surface of the diaphragm 50; and a frame 93 that fixes the diaphragm 50 thereto.

Figure 23A:
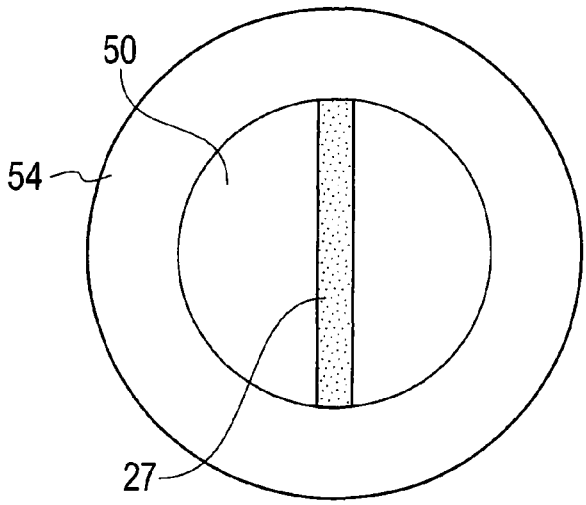
FIG. 23A is a plane view illustrating a diaphragm according to the seventh embodiment of the present invention.
Figure 23B:
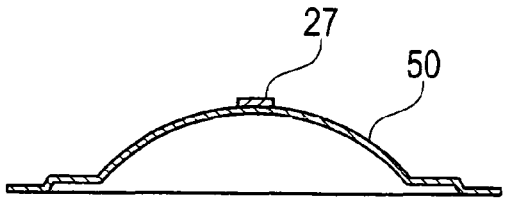
FIG. 23B is a cross-sectional view illustrating the diaphragm according to the seventh embodiment of the present invention.

As the diaphragm 50, silk, cotton, hemp, chemical fiber, a film and the like can be used as well as the uniform materials and the wooden sheet, which are mentioned in the first to sixth embodiments. A cloth edge with a predetermined shape is formed entirely on an outer circumferential portion 54 of the diaphragm 50. As shown in FIG. 23A and FIG. 23B, the standing wave suppression member 27 is linearly adhered onto a dome portion of the diaphragm 50 by the adhering means. It is preferable that a thickness of the standing wave suppression member 27 be set within the range of 10 μm to 700 μm in consideration for a relationship between the thickness concerned and a gross weight of the diaphragm 50. Note that, since a curvature of the dome portion of the diaphragm 50 is relatively large, there is a possibility that the standing wave suppression member 27 may be peeled off from the diaphragm 50 depending on a material of the standing wave suppression member 27 and the mechanical strength of the adhering means. Therefore, it is preferable to set a width of the belt of the standing wave suppression member 27 at approximately 1 mm.

Figure 24A:
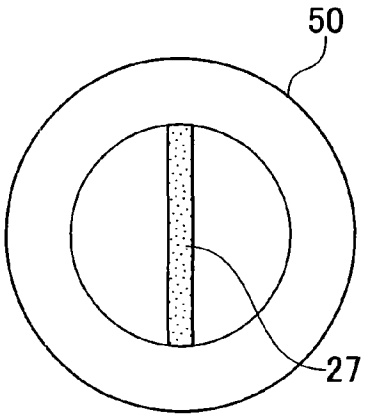
Figure 24B:
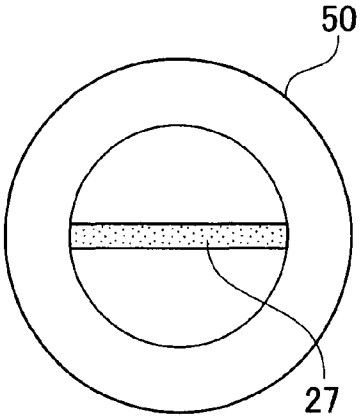
Figure 24C:
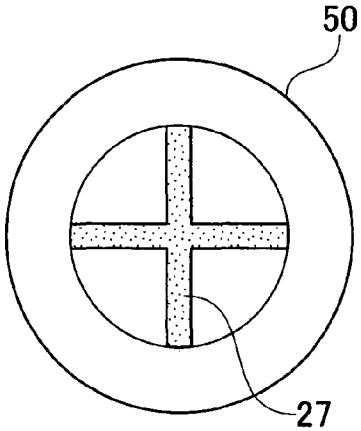
Figure 24D:
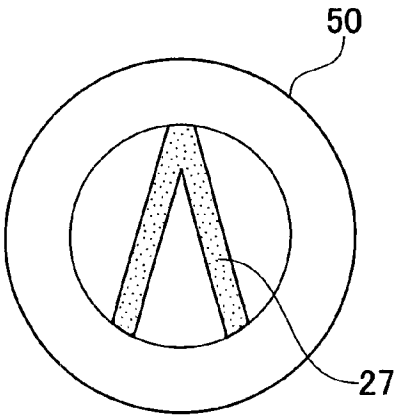
Figure 24E:
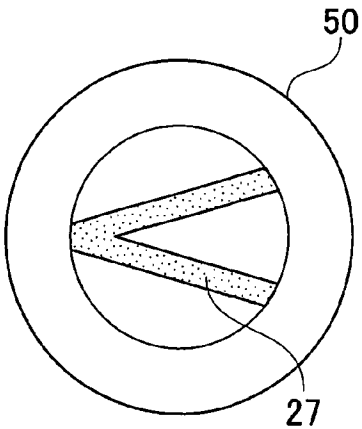
Figure 24F:
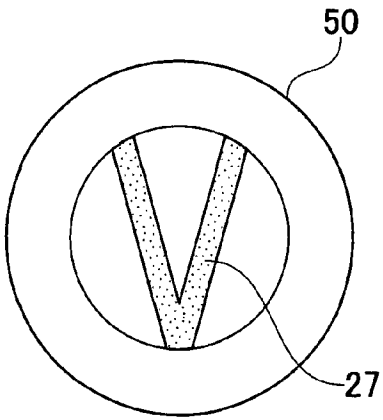
Figure 24G:
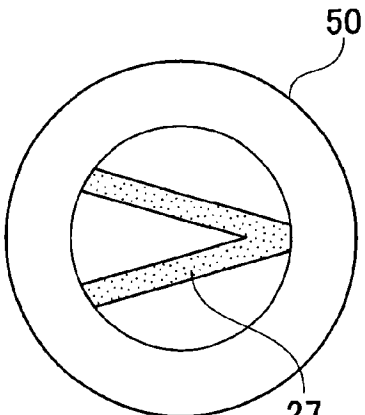

The material of the standing wave suppression member 27 can be selected in response to the usage purpose thereof. For example, a material having a faster propagation speed than the diaphragm 50 is used as the standing wave suppression member 27, whereby a sound speed in an up and down direction of a page space of FIG. 23A is accelerated. Accordingly, directivity characteristics in the up and down direction of the page space are expanded, and sound expansion in terms of the auditory sense in the up and down direction is obtained. On the contrary, a material having a slower propagation speed than the diaphragm 50 is used as the standing wave suppression member 27, whereby the sound speed in the up and down direction of the page space of FIG. 23A slows down. Accordingly, the directivity characteristics in the up and down direction are narrowed, and sound expansion in terms of the auditory sense in a left and right direction of the page space is obtained. Moreover, in the case of using the anisotropic material such as the natural wood as the standing wave suppression member 27, different sound expansion from the case shown in FIG. 23A is felt. A disposition pattern of the standing wave suppression member 27 is not limited to an example shown in FIG. 24A and FIG. 24B. For example, as shown in FIG. 24C, the standing wave suppression member 27 may be formed into a cross shape, or may be formed into V-shapes as shown in FIG. 24D to FIG. 24G.

Other Embodiments

As described above, it is a matter of course that the present invention incorporates a variety of embodiments and the like, which are not described herein. For the above-described embodiments, a variety of modifications can be implemented without departing from the spirit of the present invention.

Figure 25:
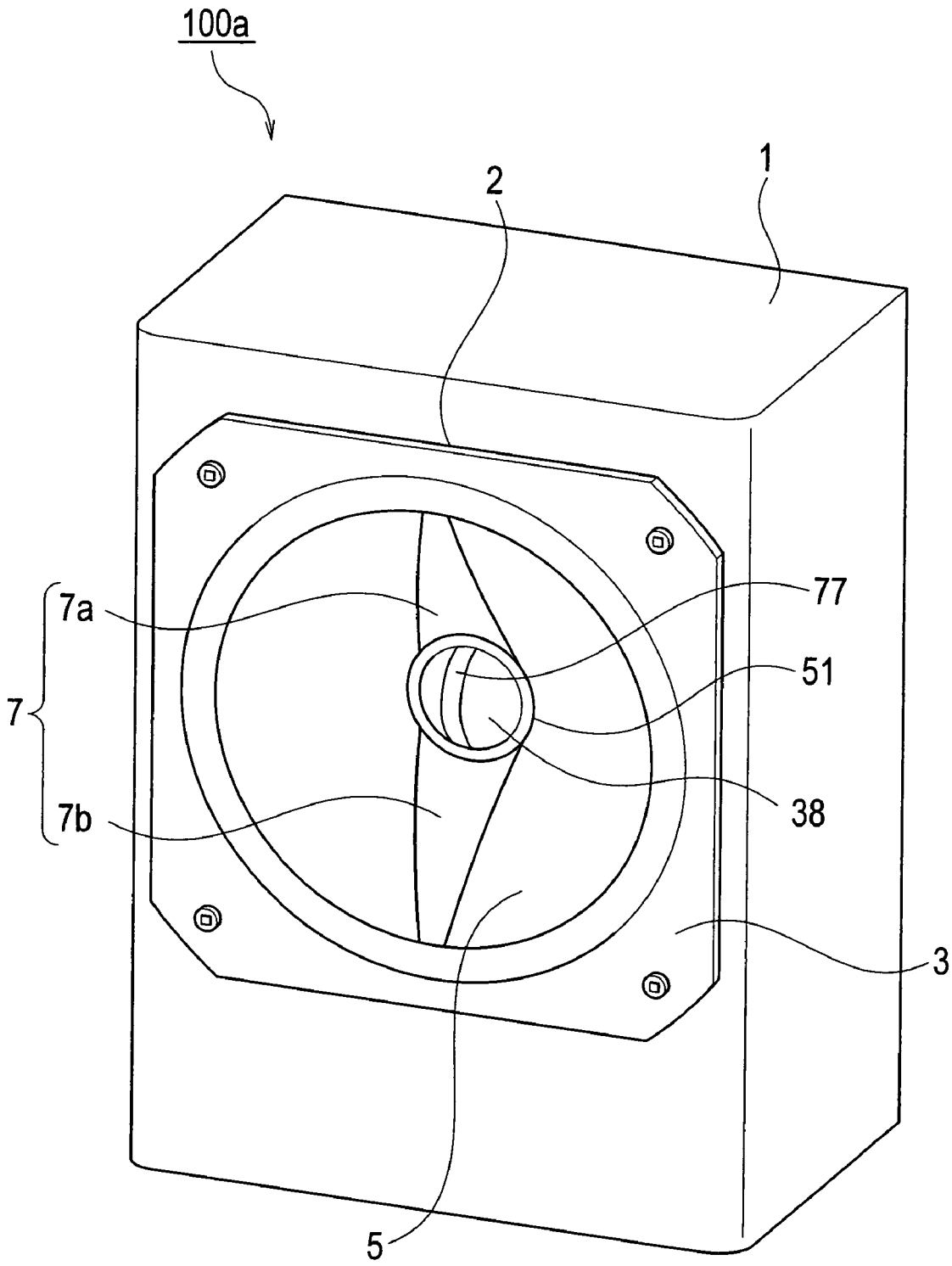
FIG. 25 is a perspective view illustrating a speaker according to other embodiment of the present invention.

As shown in FIG. 25, in the first to sixth embodiments, a reinforcement member 77 pasted on the dust cap 38 in the same direction as that of the standing wave suppression members 7*a* and 7*b* may be disposed. By disposing the reinforcement member 77, directivity characteristics of the diaphragm 5 in an up and down direction of a page space of FIG. 25 are expanded. Accordingly, sound expansion in terms of the auditory sense in the up and down direction of the page space is obtained.

In each of the first to sixth embodiments, the example has been shown, where the two standing wave suppression members 7*a* and 7*b* (or the propagation speed adjustment members 73*a* and 73*b*) opposite to each other while sandwiching the dust cap 38 therebetween are arranged. However, one standing wave suppression member (or a propagation speed adjustment member) extended from the opening portion 51 toward the outer circumferential portion may be disposed. However, a weight balance of the diaphragm 5 is impaired in this case. Therefore, it is desirable that the pair of standing wave suppression members 7*a* and 7*b* (the propagation speed adjustment members 73*a* and 73*b*) be arranged in one direction so as to be cross-sectionally symmetric to each other while sandwiching the dust cap 38 therebetween.

In the first to sixth embodiments, the speakers on which the speakers of the full range type and the tweeters (which are arbitrary) are mounted have been illustrated. However, a speaker with a 2 to 5-way structure may be constructed by mounting a midrange speaker, a woofer and the like thereon besides such a tweeter.

What is claimed is:

1. An acoustic diaphragm comprising:

a diaphragm formed of a uniform material; and a first standing wave suppression member provided in a first certain region on a surface of the diaphragm along a first direction of passing through a center of the diaphragm, and formed of a material having a different sound propagation speed from that of the uniform material.

2. The acoustic diaphragm of claim 1, wherein the first standing wave suppression member is formed of a material having a faster sound propagation speed than the uniform material.

3. The acoustic diaphragm of claim 1, wherein the first standing wave suppression member is formed of a material having a slower sound propagation speed than the uniform material.

4. The acoustic diaphragm of claim 2, further comprising a second standing wave suppression member provided on a back surface of the diaphragm and positioned opposite to the first standing wave suppression member while interposing the diaphragm therebetween, wherein the second standing wave suppression member is formed of a material having a faster sound propagation speed than that of the uniform material.

5. The acoustic diaphragm of claim 2, further comprising a second standing wave suppression member provided in a second certain region on the surface of the diaphragm along a second direction passing through the center of the diaphragm, the second direction being different from the first direction, wherein the second standing wave suppression member is formed of a material having a faster sound propagation speed than that of the uniform material.

6. The acoustic diaphragm of claim 1, wherein the first standing wave suppression member includes two members arranged in the first certain region and positioned substantially symmetrically to each other with respect to the center of the diaphragm.

7. The acoustic diaphragm of claim 4, wherein the second standing wave suppression member includes two members arranged substantially symmetrically to each other with respect to the center of the diaphragm.

8. The acoustic diaphragm of claim 5, wherein the second standing wave suppression member includes two members arranged in the second certain region and positioned substantially symmetrically to each other with respect to the center of the diaphragm.

9. An acoustic diaphragm comprising:

a wooden diaphragm; and a first propagation speed adjustment member provided in a first certain region on a surface of the wooden diaphragm along a first direction of passing through a center of the wooden diaphragm, and adjusts a propagation speed at which a sound propagates in the surface of the wooden diaphragm.

10. The acoustic diaphragm of claim 9, wherein the first propagation speed adjustment member is formed of a material having a faster sound propagation speed than the wooden diaphragm.

11. The acoustic diaphragm of claim 9, wherein the first propagation speed adjustment member is provided in the first certain region on the surface of the wooden diaphragm along the first direction passing across a fiber direction of the wooden diaphragm.

12. The acoustic diaphragm of claim 11, wherein the first propagation speed adjustment member is formed of an anisotropic material having a fiber direction in the first direction.

13. The acoustic diaphragm of claim 12, wherein the first propagation speed adjustment member is a wooden sheet.

14. The acoustic diaphragm of claim 10, further comprising a second propagation speed adjustment member provided on a back surface of the wooden diaphragm and positioned opposite to the first propagation speed adjustment member while interposing the wooden diaphragm therebetween.

15. The acoustic diaphragm of claim 10, further comprising a second propagation speed adjustment member provided in a second certain region on the surface of the wooden diaphragm along a second direction passing through the center of the wooden diaphragm, the second direction being different from the first direction.

16. The acoustic diaphragm of claim 14, wherein the second propagation speed adjustment member is formed of a material having a faster sound propagation speed than the wooden diaphragm.

17. The acoustic diaphragm of claim 15, wherein the second propagation speed adjustment member is formed of a material having a faster sound propagation speed than the wooden diaphragm.

18. The acoustic diaphragm of claim 16, wherein the second propagation speed adjustment member is formed of an anisotropic material.

19. The acoustic diaphragm of claim 17, wherein the second propagation speed adjustment member is formed of an anisotropic material.

20. The acoustic diaphragm of claim 18, wherein the second propagation speed adjustment member is a wooden sheet.

21. The acoustic diaphragm of claim 19, wherein the second propagation speed adjustment member is a wooden sheet.

22. The acoustic diaphragm of claim 9, wherein the first propagation speed adjustment member includes two members arranged in the first certain region and positioned substantially symmetrically to each other with respect to the center of the wooden diaphragm.

23. The acoustic diaphragm of claim 14, wherein the second propagation speed adjustment member includes two members arranged substantially symmetrically to each other with respect to the center of the wooden diaphragm.

24. The acoustic diaphragm of claim 15, wherein the second propagation speed adjustment member includes two members arranged in the second certain region and positioned substantially symmetrically to each other with respect to the center of the wooden diaphragm.

25. A speaker comprising:

an acoustic diaphragm including:

a diaphragm formed of a uniform material; and a first standing wave suppression member provided in a first certain region on a surface of the diaphragm along a first direction of passing through a center of the diaphragm, and formed of a material having a different sound propagation speed from that of the uniform material; and a cabinet which houses the acoustic diaphragm.

26. The speaker of claim 25, wherein the first standing wave suppression member is formed of a material having a faster sound propagation speed than the uniform material, and the first direction is a substantially perpendicular direction with respect to a bottom surface of the cabinet.

27. The speaker of claim 25, wherein the first standing wave suppression member is formed of a material having a slower sound propagation speed than the uniform material, and the first direction is a substantially horizontal direction with respect to a bottom surface of the cabinet.

28. The speaker of claim 26, wherein the acoustic diaphragm further comprises a second standing wave suppression member provided on a back surface of the diaphragm and positioned opposite to the first standing wave suppression member while interposing the diaphragm therebetween, wherein the second standing wave suppression member is formed of a material having a faster sound propagation speed than that of the uniform material.

29. The speaker of claim 26, wherein the acoustic diaphragm further comprises a second standing wave suppression member provided in a second certain region on the surface of the diaphragm along a second direction passing through the center of the diaphragm, the second direction being different from the first direction, wherein the second standing wave suppression member is formed of a material having a faster sound propagation speed than that of the uniform material.

30. The speaker of claim 25, wherein the first standing wave suppression member includes two members arranged in the first certain region and positioned substantially symmetrically to each other with respect to the center of the diaphragm.

31. The speaker of claim 28, wherein the second standing wave suppression member includes two members arranged substantially symmetrically to each other with respect to the center of the diaphragm.

32. The speaker of claim 29, wherein the second standing wave suppression member includes two members arranged in the second certain region and positioned substantially symmetrically to each other with respect to the center of the diaphragm.

33. A speaker comprising:

an acoustic diaphragm including:

a wooden diaphragm; and a first propagation speed adjustment member provided in a first certain region on a surface of the wooden diaphragm along a first direction of passing through a center of the wooden diaphragm, and adjusts a propagation speed at which a sound propagates in the surface of the wooden diaphragm; and a cabinet which houses the acoustic diaphragm.

34. The speaker of claim 33, wherein the first propagation speed adjustment member is formed of a material having a faster sound propagation speed than the wooden diaphragm.

35. The speaker of claim 33, wherein the first propagation speed adjustment member is provided in the first certain region on a surface of the wooden diaphragm along the first direction passing across a fiber direction of the wooden diaphragm.

36. The speaker of claim 35, wherein the first propagation speed adjustment member is formed of an anisotropic material having a fiber direction in the first direction.

37. The speaker of claim 33, wherein the first propagation speed adjustment member is a wooden sheet.

38. The speaker of claim 34, further comprising a second propagation speed adjustment member provided on a back surface of the wooden diaphragm and positioned opposite to the first propagation speed adjustment member while interposing the wooden diaphragm therebetween.

39. The speaker of claim 34, further comprising a second propagation speed adjustment member provided in a second certain region on the surface of the wooden diaphragm along a second direction passing through the center of the wooden diaphragm, the second direction being different from the first direction.

40. The speaker of claim 39, wherein the first direction is a horizontal direction with respect to a bottom surface of the cabinet and the second direction is an oblique direction with respect to the horizontal direction.

41. The speaker of claim 38, wherein the second propagation speed adjustment member is formed of a material having a faster sound propagation speed than the wooden diaphragm.

42. The speaker of claim 39, wherein the second propagation speed adjustment member is formed of a material haying a faster sound propagation speed than that of the wooden diaphragm.

43. The speaker of claim 41, wherein the second propagation speed adjustment member is formed of an anisotropic material.

44. The speaker of claim 42, wherein the second propagation speed adjustment member is formed of an anisotropic material.

45. The speaker of claim 43, wherein the second propagation speed adjustment member is a wooden sheet.

46. The speaker of claim 44, wherein the second propagation speed adjustment member is a wooden sheet.

47. The speaker of claim 33, wherein the first propagation speed adjustment member includes two members arranged in the first certain region and positioned substantially symmetrically to each other with respect to the center of the wooden diaphragm.

48. The speaker of claim 38, wherein the second propagation speed adjustment member includes two members arranged substantially symmetrically to each other with respect to the center of the wooden diaphragm.

49. The speaker of claim 39, wherein the second propagation speed adjustment member includes two members arranged in the second certain region and positioned substantially symmetrically to each other with respect to the center of the wooden diaphragm.

50. A speaker comprising:

a cabinet including a first opening and a second opening, which are spaced from each other;

a first diaphragm mounted onto the first opening;

a second diaphragm mounted onto the second opening;

a first standing wave suppression member formed of a material having a faster sound propagation speed than the first diaphragm, and disposed in a first certain region on a surface of the first diaphragm in a substantially horizontal direction with respect to a bottom surface of the cabinet;

a second standing wave suppression member formed of the material having a faster sound propagation speed than the first diaphragm, and disposed in a second certain region on the surface of the first diaphragm obliquely with respect to the horizontal direction;

a third standing wave suppression member formed of a material having a faster sound speed than the second diaphragm, and disposed in the first certain region on a surface of the second diaphragm in the substantially horizontal direction with respect to the bottom surface of the cabinet; and a fourth standing wave suppression member formed of the material having a faster sound propagation speed than the second diaphragm, and disposed in the second certain region on the surface of the second diaphragm obliquely with respect to the horizontal direction, wherein the second standing wave suppression member and the fourth standing wave suppression member are inclined reversely to each other with respect to a center plane of the cabinet, the center plane intersecting perpendicularly to the bottom surface of the cabinet.

51. The speaker of claim 50, wherein the first standing wave suppression member includes two members arranged in the first certain region on the surface of the first diaphragm and positioned substantially symmetrically to each other with respect to a center of the first diaphragm, wherein the second standing wave suppression member includes two members arranged in the second certain region on the surface of the first diaphragm and positioned substantially symmetrically to each other with respect to the center of the first diaphragm, wherein the third standing wave suppression member includes two members arranged in the first certain region on the surface of the second diaphragm and positioned substantially symmetrically to each other with respect to a center of the second diaphragm, and wherein the fourth standing wave suppression member includes two members arranged in the second certain region on the surface of the second diaphragm and positioned substantially symmetrically to each other with respect to the center of the second diaphragm.

52. A speaker comprising:

a cabinet including a first opening and a second opening, which are spaced from each other;

a first wooden diaphragm mounted onto the first opening;

a second wooden diaphragm mounted onto the second opening;

a first propagation speed adjustment member disposed in a first certain region on a surface of the first wooden diaphragm in a substantially horizontal direction with respect to a bottom surface of the cabinet, and adjusts a propagation speed at which a sound propagates in the surface of the first wooden diaphragm;

a second propagation speed adjustment member disposed in a second certain region on the surface of the first wooden diaphragm obliquely with respect to the horizontal direction, and adjusts the propagation speed at which the sound propagates in the surface of the first wooden diaphragm;

a third propagation speed adjustment member disposed in the first certain region on a surface of the second wooden diaphragm in the substantially horizontal direction with respect to the bottom surface of the cabinet, and adjusts a propagation speed at which a sound propagates in the surface of the second wooden diaphragm; and a fourth propagation speed adjustment member disposed in the second certain region on the surface of the second wooden diaphragm obliquely with respect to the horizontal direction, and adjusts the propagation speed at which the sound propagates in the surface of the second wooden diaphragm, wherein the second propagation speed adjustment member and the fourth propagation speed adjustment member are inclined reversely to each other with respect to a center plane of the cabinet, the center plane intersecting perpendicularly to the bottom surface of the cabinet.

53. The speaker of claim 52, wherein of the first standing wave suppression member includes two members arranged in the first certain region on the surface of the first diaphragm and positioned substantially symmetrically to each other with respect to a center of the first wooden diaphragm, wherein the second standing wave suppression member includes two members arranged in the second certain region on the surface of the first diaphragm and positioned substantially symmetrically to each other with respect to the center of the first diaphragm, wherein the third standing wave suppression member includes two members arranged in the first certain region on the surface of the second diaphragm and positioned substantially symmetrically to each other with respect to a center of the second diaphragm, and wherein the fourth standing wave suppression member includes two members arranged in the second certain region on the surface of the second diaphragm and positioned substantially symmetrically to each other with respect to the center of the second diaphragm.

* * * * *

UNITED STATES PATENT AND TRADEMARK OFFICE

CERTIFICATE OF CORRECTION

PATENT NO. : 7,845,461 B2
APPLICATION NO. : 12/222286
DATED : December 7, 2010
INVENTOR(S) : Satoshi Imamura et al.

It is certified that error appears in the above-identified patent and that said Letters Patent is hereby corrected as shown below:

Column 20, Claim 42, Line 25
Please delete "speed adjustment member is formed of a material haying" and replace with -- speed adjustment member is formed of a material having --

Column 22, Claim 53, Line 26
Please delete "The speaker of claim 52, wherein of the first standing" and replace with -- The speaker of claim 52, wherein the first standing --

Signed and Sealed this
First Day of February, 2011

David J. Kappos

David J. Kappos
*Director of the United States Patent and Trademark Office*